US007032991B1

(12) United States Patent
Otsuka et al.

(10) Patent No.: US 7,032,991 B1
(45) Date of Patent: Apr. 25, 2006

(54) TWO-WAY PRINT APPARATUS AND PRINT METHOD

(75) Inventors: Naoji Otsuka, Yokohama (JP); Osamu Iwasaki, Tokyo (JP); Kaneji Yamada, Tokyo (JP); Toshiyuki Chikuma, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/675,165

(22) Filed: Sep. 29, 2000

(30) Foreign Application Priority Data

Sep. 30, 1999 (JP) ..... 11-278936

(51) Int. Cl.
*B41J 2/21* (2006.01)
*B41J 2/15* (2006.01)
*B41J 2/145* (2006.01)

(52) U.S. Cl. ..... 347/43; 347/40

(58) Field of Classification Search ..... 347/43, 347/9, 40, 42, 41, 16, 12
See application file for complete search history.

(56) References Cited

U.S. PATENT DOCUMENTS

| | | | | |
|---|---|---|---|---|
| 4,313,124 | A | 1/1982 | Hara | 347/57 |
| 4,345,262 | A | 8/1982 | Shirato et al. | 347/10 |
| 4,459,600 | A | 7/1984 | Sato et al. | 347/47 |
| 4,463,359 | A | 7/1984 | Ayata et al. | 347/5.6 |
| 4,528,576 | A | 7/1985 | Koumura et al. | 347/43 |
| 4,558,333 | A | 12/1985 | Sugitani et al. | 347/65 |
| 4,593,295 | A | 6/1986 | Matsufuji et al. | 347/43 |
| 4,723,129 | A | 2/1988 | Endo et al. | 347/56 |
| 4,740,796 | A | 4/1988 | Endo et al. | 347/5.6 |
| 4,748,453 | A * | 5/1988 | Lin et al. | 347/15 |
| 5,774,146 | A * | 6/1998 | Mizutani | 347/43 |
| 6,254,217 | B1 * | 7/2001 | Askeland et al. | 347/43 |

FOREIGN PATENT DOCUMENTS

| | | | | |
|---|---|---|---|---|
| EP | 0 955 174 | | 11/1999 | |
| EP | 1 072 421 | | 1/2001 | |
| JP | 79-56847 | | 5/1979 | |
| JP | 59-123670 | | 7/1984 | |
| JP | 84-138461 | | 8/1984 | |
| JP | 85-71260 | | 4/1985 | |
| JP | 0045351 | * | 2/1991 | 347/43 |

OTHER PUBLICATIONS

Patent Abstracts of Japan, vol. 1997, No. 03, Pub. No. 08295034, Pub. Date Nov. 12, 1996.
Patent Abstracts of Japan, vol. 1995, No. 11, Pub. No. 07195715, Pub. Date Jan. 8, 1995.

* cited by examiner

*Primary Examiner*—Thinh Nguyen
(74) *Attorney, Agent, or Firm*—Fitzpatrick, Cella, Harper & Scinto

(57) ABSTRACT

Two sets of recording heads for applying ink of cyan (C), magenta (M), and yellow (Y) are arranged in symmetry in a scanning direction and orders of colors C and M ejected onto a pixel of a secondary color are set to symmetric orders (C→M and M→C). This makes the application orders of ink symmetric in each pixel of secondary color and thus there is no difference between application orders in formation of the pixel by either forward or backward scanning, whereby occurrence of uneven color due to the application orders of ink can be reduced even in execution of two-way color print.

28 Claims, 19 Drawing Sheets

TWO-WAY PRINT APPARATUS AND PRINT METHOD

BACKGROUND OF THE INVENTION

1. Field of the Invention

The present invention relates to a two-way print apparatus and method for implementing color print by two-way scanning of a recording head for applying ink materials of plural colors onto a print medium and, more particularly, to a two-way print apparatus and method capable of reducing uneven color occurring in two-way color print.

2. Related Background Art

In the field of the print apparatus, particularly, in the field of the print apparatus of the ink jet type, a significant subject is increase in recording speed for color print. Common techniques for increasing the recording speed include increase in recording (driving) frequency of the recording head, two-way print, etc., in addition to increase in the length of the recording head. In comparison with one-way print, the two-way print is an effective means in terms of cost as a total system, because necessary energy is dispersed on a time basis in order to gain equal throughput.

The two-way print methods, however, had a principle-based problem that uneven color occurred in a bandlike shape, because an ejection (or application) order of the ink materials of the respective colors was different in the forward direction of main scan from that in the backward direction, depending upon the recording device, particularly, depending upon the structure of the recording head. Since this problem is caused by the ejection orders of the ink materials, it appears as difference in coloring more or less where dots of different colors overlap even a little, as discussed below.

When an image is formed by applying the color materials such as pigment or dye ink materials or the like onto a print medium, an ink material of a precedently recorded dot first dyes the print medium from the surface layer to the inside of the print material. In a case whose an ink material for formation of a subsequent dot is laid in an at least partly overlapping state on the precedently recorded dot on the print medium, a large amount of ink dyes the medium in the part below the portion already dyed by the preceding ink, and thus the precedently applied ink tends to color stronger. For that reason, in the case of the conventional devices where ejection nozzles of the respective colors were arranged in the main scanning direction, since the ejection order of the ink materials in backward scanning was reverse to that in forward scanning in the two-way print, the difference of coloring caused the bandlike uneven color.

This phenomenon is not limited to only ink, but also occurs similarly with wax-based color materials and the like for process color because of the precedent-subsequent relation, though the principles are different.

Ink jet printers supporting the two-way print heretofore were constructed to avoid this problem by the following techniques.

1) To allow uneven color; or to implement the two-way print of only black (Bk).

2) To arrange the nozzles of the respective colors in the sub-scanning direction, i.e., arrange them in so-called vertical layout.

3) To provide forward nozzles and backward nozzles and switch between nozzles or heads to be used for forward scanning and for backward scanning so as to equate ejection orders of colors (refer to Japanese Patent Publication No. 03-77066).

4) To implement interlace print for rasters printed in the forward scanning and in the backward scanning, so as to complementarily cause uneven color due to difference between ejection orders at high frequency per recorded raster, thereby achieving visually uniform appearance (refer to Japanese Patent Publication No. 02-41421 and Japanese Patent Application Laid-Open No. 07-112534).

However, the above prior art 1) was not an essential solution and had such a drawback that the throughput was considerably lowered in the case of inclusion of a color image. The vertical layout of 2) realized the equal ejection orders in the forward scanning and in the backward scanning, but it had such a drawback that the recording head became long and another drawback of being weak against the difference in coloring due to time difference of ejection between colors.

In the method of 3), though the recording head for forward scanning and the recording head for backward scanning were integrated on a common substrate, this was equivalent to a configuration wherein two completely different recording heads were prepared. Therefore, the method had such a drawback that there occurred the bandlike uneven color with great color difference similar to that due to the difference between heads. For example, in the case where there was difference between temperature-increasing rates of the recording heads due to difference between ratios of forward and backward data from interference with data, there was difference in ejection amounts between the recording heads, and the uneven color occurred in the bandlike shape.

The method 4) was a technique of causing regular uneven color at high frequency so as to make the uneven color unlikely to be visually perceived, and for that reason, the color difference was enhanced in certain cases because of interference, depending upon print data. For example, in a configuration where the color difference was made per raster, great color difference appeared if there existed portions with high incidence of only even rasters and portions with high incidence of only odd rasters in the forward scanning and in the backward scanning in a half-tone area such as a mesh area or the like.

SUMMARY OF THE INVENTION

The present invention has been accomplished in order to solve the above problems and an object of the present invention is thus to provide a two-way print apparatus and method capable of reducing occurrence of uneven color due to scanning directions even in the two-way color print.

Further, another object of the present invention is to provide a two-way print apparatus and method capable of reducing occurrence of uneven color due to scanning directions, irrespective of print data.

In order to accomplish the above objects, the present invention provides a print apparatus for forming a color image by applying ink materials of plural colors onto a print medium while scanning a recording head in two directions, wherein, in order to make orders of application of an ink material of a certain color out of ink materials of plural colors applied onto a pixel area of a secondary color to form the secondary color, symmetric with respect to an ink material of another color, at least the ink material of said certain color is applied plural times onto said pixel area.

Further, the present invention provides a print apparatus for forming a color image by applying ink materials of plural colors onto a print medium while scanning the print medium in two directions with a recording head, wherein, in order to make orders of application of an ink material of a certain color out of ink materials of plural colors applied onto a pixel area of a process color to form the process color, symmetric with respect to an ink material of another color, at least the ink material of said certain color is applied plural times onto said pixel area.

Further, the present invention provides a print method for forming a color image by applying ink materials of plural colors onto a print medium while scanning a recording head in two directions, the print method comprising:

a first step of applying an ink material of a certain color for forming a secondary color on a pixel area of the secondary color, onto said pixel area;

a second step of applying an ink material of another color onto said pixel area for forming the secondary color in combination with said certain color, after the application of the ink of said certain color; and a third step of applying the ink material of said certain color onto said pixel area, after the application of the ink of said another color.

Further, another print method according to the present invention is a print method for forming a color image by applying ink materials of plural colors onto a print medium while scanning a recording head in two directions, the print method comprising:

a first step of applying an ink material of a certain color for forming a secondary color on a pixel area of the secondary color and an ink material of another color for forming said secondary color in combination with said certain color, onto said pixel area in the order named; and a second step of applying the ink material of said certain color and the ink material of said another color onto said pixel area in an order symmetric with said order.

According to the above, the ink applied in the symmetric application orders is dominant in the pixel area of the process color including the secondary color. Therefore, there is no difference between the application orders in formation of the pixel area in the forward scanning and in the backward scanning, so that it becomes feasible to reduce the uneven color due to the application orders of ink.

The "print medium" stated herein is not limited to only ordinary paper used in the print apparatus, but also generally means any medium capable of accepting ink, including fabric, plastic film, metal sheet, and so on.

The "ink materials" should also be interpreted in a broad sense, similar to the definition of the above "print," and mean liquids capable of being used for formation of image, chart, pattern, etc. or for process of the print medium when applied onto the print medium.

Further, the "pixel area" means a minimum area for expressing a primary color or a secondary color when an ink material or a plurality of ink materials are applied thereonto, and includes a super pixel and a sub-pixel as well as a pixel. The number of scans necessary for completion of the pixel area is not limited to one, but may be two or more.

Further, the "process color" means a color resulting from coloring of ink materials of three or more colors mixed on the print medium, including the secondary color.

DESCRIPTION OF THE PREFERRED EMBODIMENTS

Figure 3:
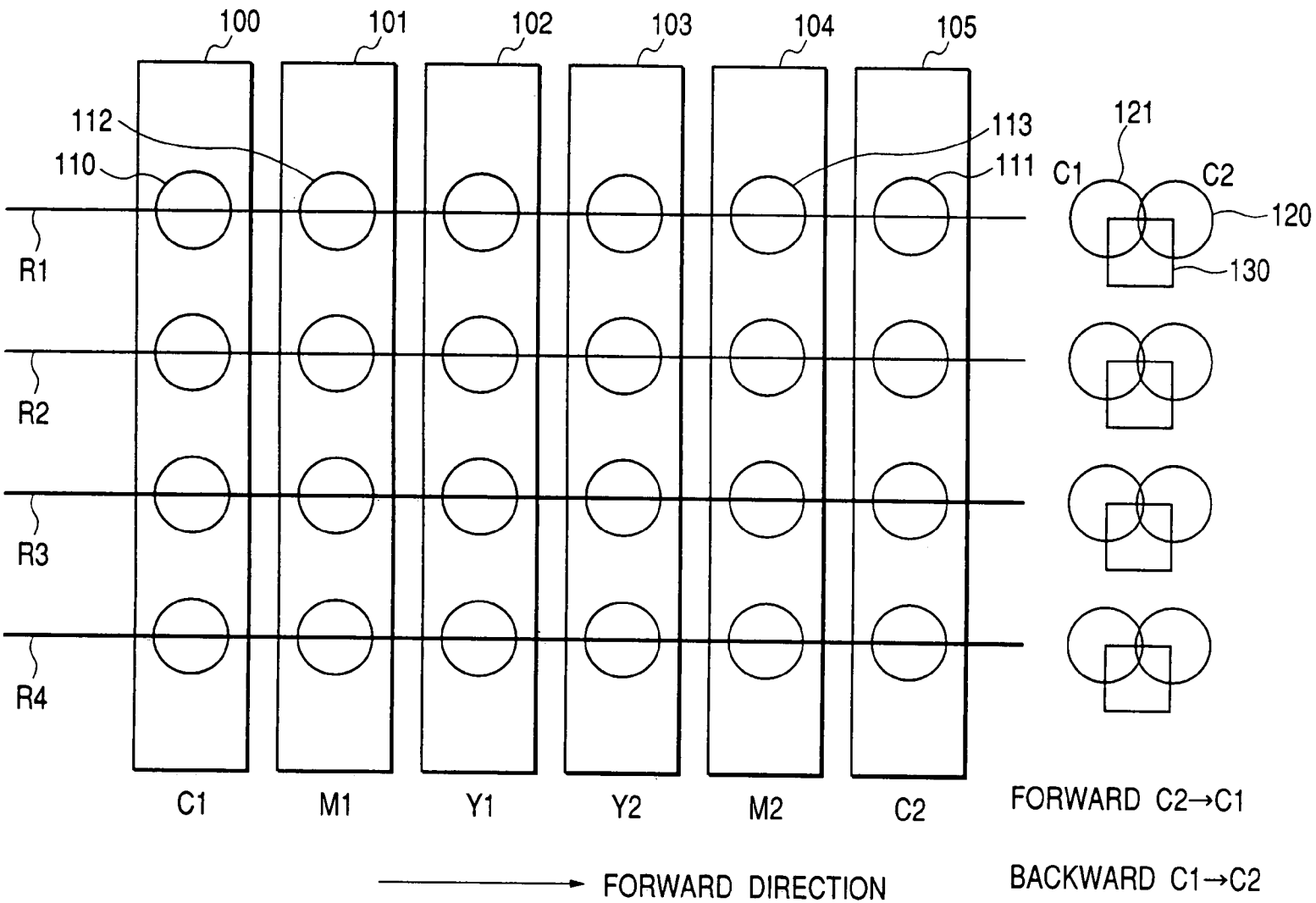
FIG. 3 is a diagram to show an example of arrangement of recording heads and ejection nozzles and structure of pixels in Embodiment 1.

Embodiments of the present invention involve the preferred embodiment where the recording heads used are arranged in such layout that recording nozzles of respective colors are arranged in symmetric sequence when observed at least in the main scanning direction, e.g., as illustrated in FIG. 3, and that ink materials of respective colors are ejected from the nozzles of the respective colors onto the print medium in symmetric ejection orders of colors for each pixel. In print with the recording heads of this structure, where the process color including the secondary color is provided for each pixel, ink is applied plural times from at least one nozzle out of those of primary colors and the nozzles are arranged in symmetric orders in forward scanning and in backward scanning when observed in the main scanning direction, thereby permitting improvement in the uneven color due to the two-way print, which occurred because of tuning with shape data itself such as horizontal rules or the like or because of tuning with half toning such as dithers or the like in the conventional examples.

The embodiments of the present invention will be described below in detail with reference to the drawings. In the drawings, elements indicated by the same reference symbols denote like or equivalent elements.

Figure 1:
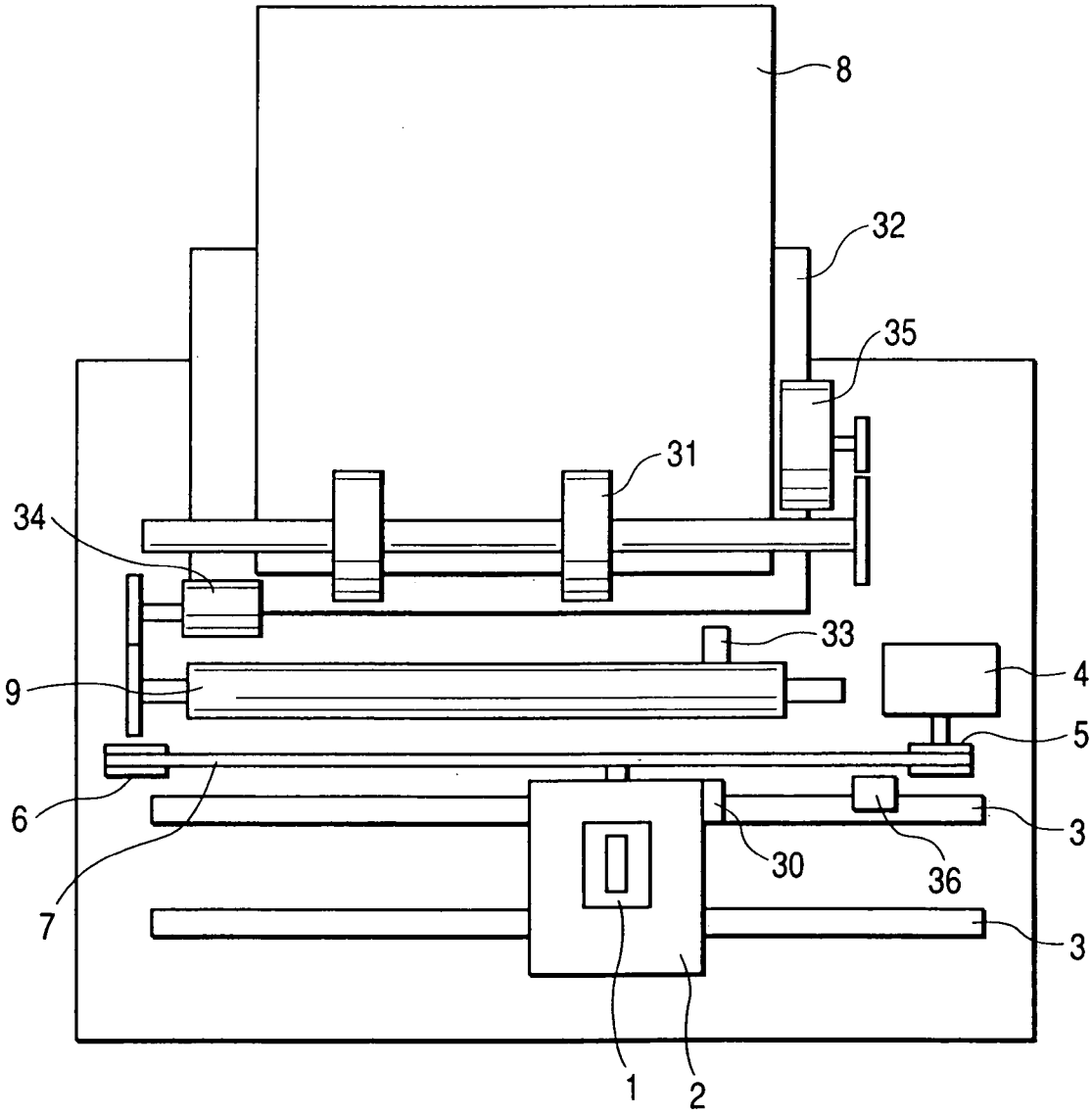
FIG. 1 is a diagram to show the schematic structure of an ink jet print apparatus according to an embodiment of the present invention.

FIG. 1 is a diagram to show the structure of the principal part in an embodiment of the ink jet print apparatus according to the present invention.

In FIG. 1, a head cartridge 1 is mounted in a replaceable state on a carriage 2. The head cartridge 1 has a print head section and an ink tank section and is provided with a connector (not illustrated) for transmitting and receiving signals for driving the head section and others.

The head cartridge 1 is positioned and mounted in the replaceable state on the carriage 2 and the carriage 2 is provided with a connector holder (electrical connection) for transmitting driving signals, etc. through the aforementioned connector to each head cartridge 1.

The carriage 2 is guided and supported so as to be movable forward and backward along a guide shaft 3 extending in the main scanning direction and set on the main body of apparatus. The carriage 2 is driven through a driving mechanism consisting of a motor pulley 5, a driven pulley 6, a timing belt 7, etc. by a main scanning motor 4 and the position and movement thereof are controlled thereby. A home position sensor 30 is disposed on the carriage. This permits the apparatus to detect the position when the home position sensor 30 on the carriage 2 passes the position of a shield plate 36.

Print media 8 such as print sheets, plastic thin films, or the like are separated and fed one by one from an auto sheet feeder (hereinafter referred to as ASF) 32 by rotating pickup rollers 31 via gears by a sheet feed motor 35. Further, with rotation of carry rollers 9, a print medium is carried (sub-scanned) through the position (print section) opposite to an ejection port surface of the head cartridge 1. The carry rollers 9 are rotated via gears with rotation of LF motor 34. On that occasion, it is determined whether the medium has been fed and the position of the leading end of the medium in the feed operation is determined, when the print medium 8 passes a paper end sensor 33. Further, the paper end sensor 33 is also used for detecting the actual position of the rear end of the print medium 8 and finally determining a current recording position from the actual rear end.

The print medium 8 is supported by a platen (not illustrated) on the back surface thereof so as to form a flat print surface in the print section. In this case, each head cartridge 1 mounted on the carriage 2 is held so that its ejection port surface projects downward from the carriage 2 and is parallel to the print medium 8 between the aforementioned pair of two carry rollers.

The head cartridge 1 is, for example, an ink jet head cartridge for ejecting ink by use of thermal energy, which is provided with electrothermal transducers for generating thermal energy. The print head of the head cartridge 1 is designed to implement the print by ejecting ink from each ejection port while making use of pressure of a bubble formed by film boiling due to the thermal energy applied by the above electrothermal transducer. Of course, the ejection method can also be selected from other methods including ejection of ink by piezoelectric elements or the like.

Figure 2:
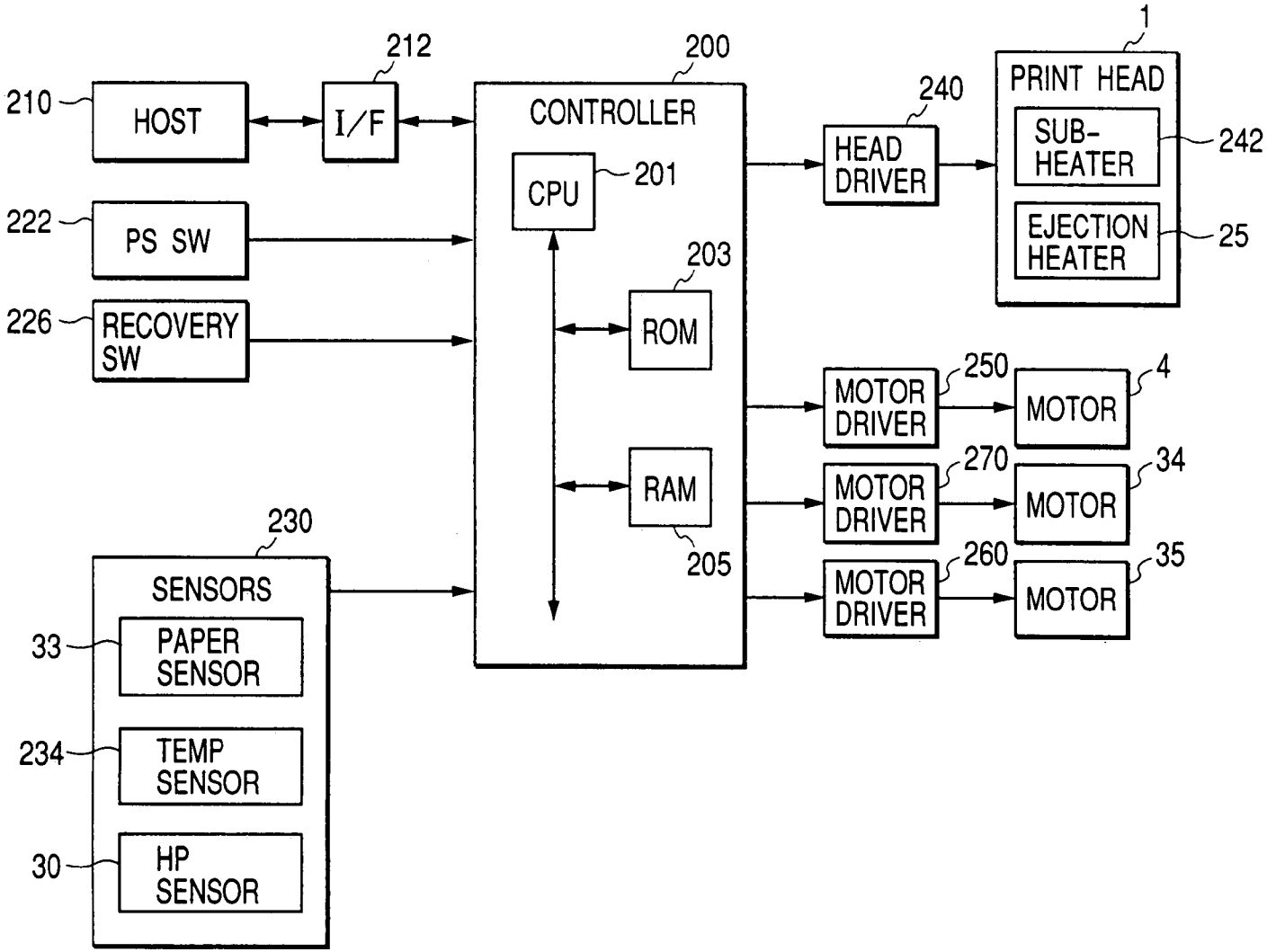
FIG. 2 is a block diagram to show the setup of a control circuit in the print apparatus.

FIG. 2 is a block diagram to show an example of schematic structure of a control circuit in the above ink jet print apparatus.

In FIG. 2, a controller 200 is a main control unit, which is, for example, one having a CPU 201 of a microcomputer form, a ROM 203 storing programs, necessary tables, and other fixed data, and a RAM 205 including an area for expansion of image data, a working area, and so on. A host device 210 is an image data supply (which can be a computer for performing preparation, processing, etc. of data of an image or the like associated with the print, or a form of a reader part or the like for reading of an image). The image data, other commands, a status signal, etc. are sent or received through an interface (I/F) 212 to or from the controller 200.

A control section 120 has switches for accepting entry of instructions by an operator, which include a power switch 222, a recovery switch 226 for giving instructions for actuating suction recovery, and so on.

Sensors 230 are sensors for detecting the status of the apparatus, which include the aforementioned home position sensor 30, the paper end sensor 33 for detecting presence or absence of the print medium, a temperature sensor 234 disposed at an appropriate position for detecting the ambient temperature, and so on.

A head driver 240 is a driver for driving ejection heaters 25 of the print head 1 according to print data or the like. The head driver 240 has a shift register for aligning the print data corresponding to positions of ejection heaters 25, a latch circuit for latching signals at appropriate timing, and a logic circuit element for actuating the ejection heaters in synchronism with driving timing signals and, in addition thereto, has a timing setting section for appropriately setting the driving timing (ejection timing) for alignment of forming positions of dots, and so on.

The print head 1 incorporates sub-heaters 242. The sub-heaters 242 are heaters for temperature control to stabilize ejection characteristics of ink and can be constructed in a form wherein they are built together with the ejection heaters 25 on a print head substrate and/or in a form wherein they are mounted on the print head body or on the head cartridge.

A motor driver 250 is a driver for driving the main scanning motor 4, the sub-scanning motor 34 is a motor used for conveying (or sub-scanning) the print medium 8, and a motor driver 270 is a driver for the motor 34.

The sheet feed motor 35 is a motor used for separation and feed of the print medium 8 from the ASF and a motor driver 260 is a driver for the motor 35.

Embodiment 1

FIG. 3 is a schematic diagram to partially show the structure of the principal part of the recording head section in the head cartridge 1. In FIG. 3, numeral 100 designates a first recording head (hereinafter referred to as C1) for ejecting cyan ink. Numeral 101 denotes a first recording head (M1) for ejecting magenta ink. Numeral 102 is a first recording head (Y1) for ejecting yellow ink. Numeral 103 represents a second recording head (Y2) for ejecting yellow ink. Numeral 104 indicates a second recording head (M2) for ejecting magenta ink. Numeral 105 is a second recording head (C2) for ejecting cyan ink. Further, the head cartridge may also be provided with a recording head of Bk in addition to the above heads.

The group of these recording heads are incorporated to form the head cartridge 1. In the head cartridge 1, each of these recording heads has a plurality of ejection nozzles. For example, in the recording head 100 (C1), numeral 110 denotes cyan ejection nozzles. In the recording head 101 (M1), numeral 112 represents magenta ejection nozzles. In the recording head 104 (M2), numeral 113 indicates magenta ejection nozzles. In the recording head 105 (C2), numeral 111 designates cyan ejection nozzles.

The nozzles in each recording head are aligned in a direction approximately normal to the main scanning direction. Precisely speaking, there are cases where the nozzles are arranged slightly obliquely relative to the main scanning direction in connection with the ejection timing. Further, these recording heads are arranged in the same direction as the main scanning direction. Specifically, in the case of FIG. 2, the recording heads 100 (C1), 101 (M1), 102 (Y1), 103 (Y2), 104 (M2), and 105 (C2) are arranged in the same direction as the main scanning direction.

In the same figure a dot position 121 and a dot position 120 indicate, respectively, positions of a dot ejected from an ejection nozzle 110 of the recording head 100 (C1) and a dot ejected from an ejection nozzle 111 of the recording head 105 (C2) onto an area of a pixel (picture element) 130. In this example, the dot position 120 indicates the right upper corner position in the drawing and the dot position 121 the left upper corner position. R1 to R4 represent main scanning lines or rasters for formation of respective pixels. In this example, a pixel is formed in one raster or one scan.

The example illustrated in FIG. 3 shows a case in which the primary color of cyan is printed. It shows a state in which a pair of two dots at the dot position 120 and at the dot position 121 are printed for a pixel 130. In this case, let us define a forward scan as a scan in which the head cartridge 1 moves in the direction indicated by an arrow in the figure. In the forward scan, an order of dots ejected into the pixel 130 is the recording head 105 (C2)→the recording head 100 (C1); in the backward scan, the order is C1→C2. In the case of primary color, however, ink of the same color is ejected in the both scans, and thus there appears no difference in coloring due to the ejection orders.

Figure 4:
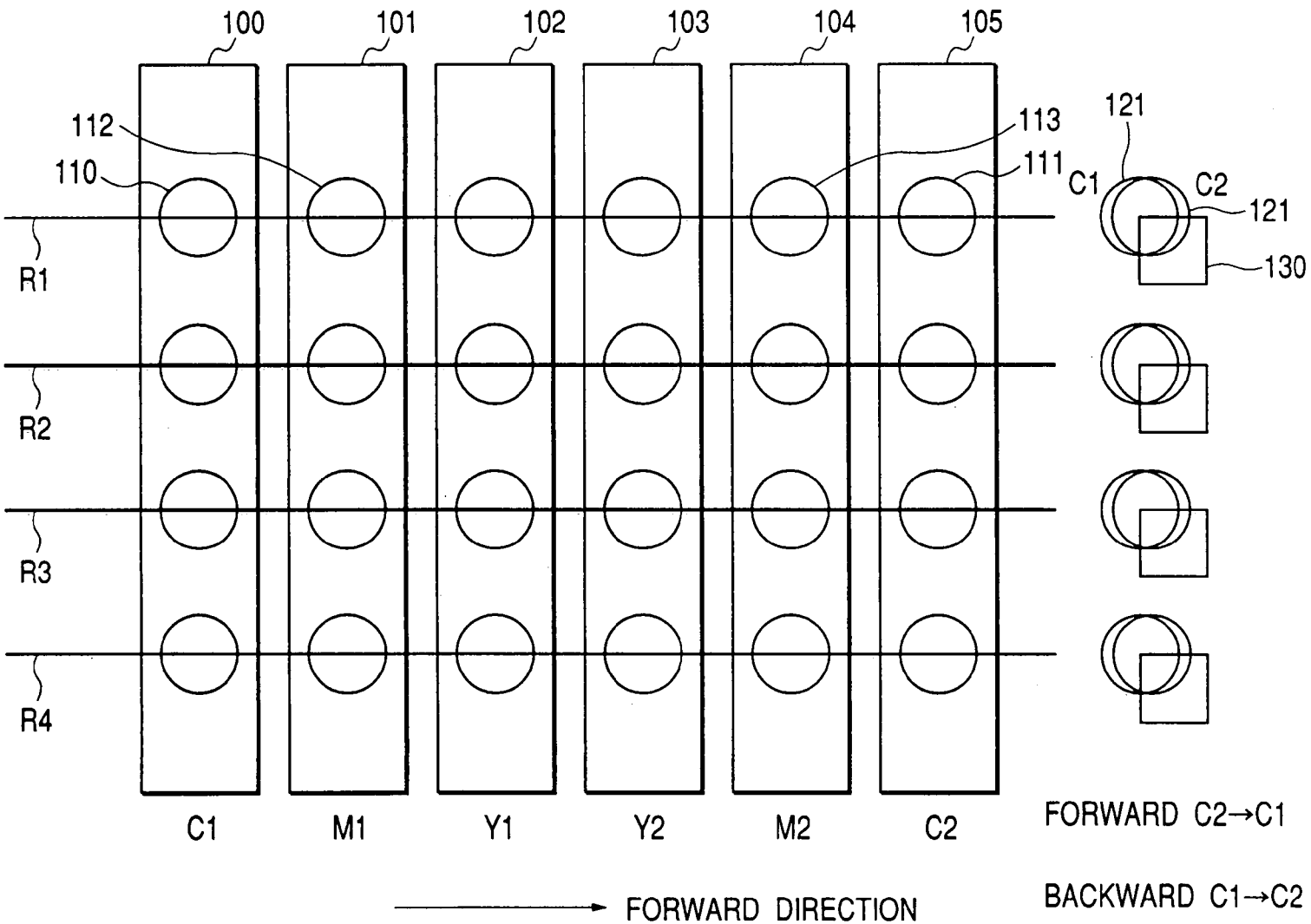
FIG. 4 is a diagram to show another example of arrangement of recording heads and ejection nozzles and structure of pixels.

FIG. 4 shows a case in which two dots are laid at the dot position 121 of the pixel 130 by use of the head cartridge 1 of the same structure as in FIG. 3. In this case, different from the structure of the pixel 130 in FIG. 3, the dots are almost superimposed in a dot-on-dot configuration, and thus this is the dot layout demonstrating the strongest coloring of the precedently recorded dot. Since this case is also an example of primary color to place the dots of the same color, there appears no difference in coloring between in the forward scan and in the backward scan.

Figure 5:
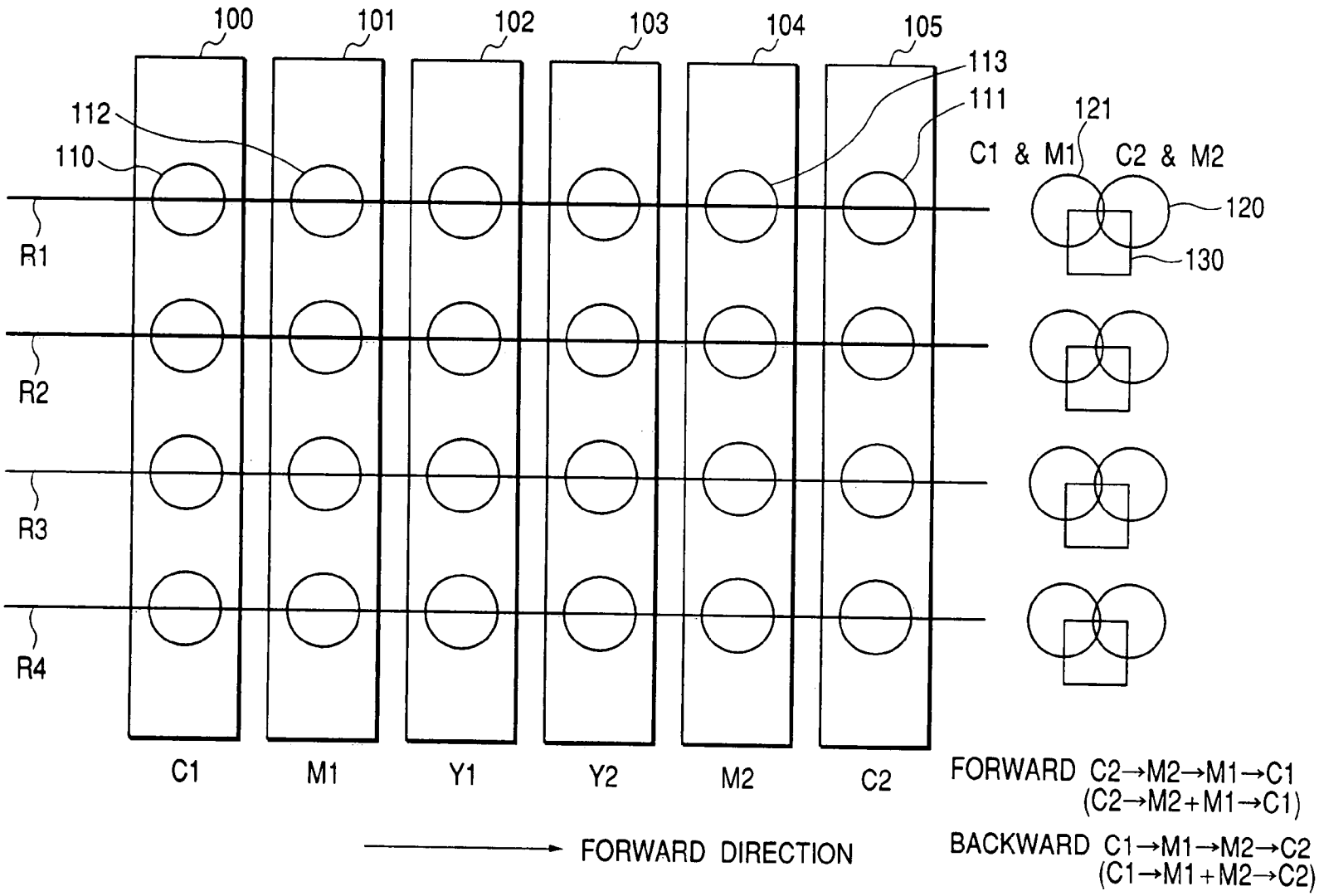
FIG. 5 is a diagram to show still another example of arrangement of recording heads and ejection nozzles and structure of pixels.

FIG. 5 shows a case in which dots of cyan and magenta are laid at each of the dot positions 120, 121 of the pixel 130 by use of the head cartridge 1 of the same structure as in FIG. 3. In this case, different from the structure of the pixel 130 of FIG. 3, the ink materials of the respective colors are laid in the dot-on-dot configuration for each pixel structure. For example, where blue is expressed as a secondary color, cyan and magenta are used. At the dot position 121, in the forward scan the ink materials of the respective colors are ejected onto the print medium in the order of the dot from the magenta ejection nozzle 112 of the recording head 101 (M1) and the dot from the cyan ejection nozzle 110 of the recording head 100 (C1). According to the aforementioned principle, at the dot position 121 there normally appears such a dot inclined toward red purple that coloring of the magenta ink ejected (or landed) first is dominant.

Likewise, at the dot position 120, the ink materials in the forward scan are ejected onto the print medium in the order of the dot from the cyan ejection nozzle 111 of the recording head 105 (C2) and the dot from the magenta ejection nozzle 113 of the recording head 104 (M2). According to the aforementioned principle, at the dot position 120 there normally appears such a dot inclined toward violet that coloring of the cyan ink ejected first is dominant.

Let us next consider print states in the backward scan this time. In the backward scan, the ink materials are ejected (or landed) onto the print medium in the order of the dot from the cyan ejection nozzle 110 of the recording head 100 (C1) and the dot from the magenta ejection nozzle 112 of the recording head 101 (M1). At the dot position 121 the dot normally colors as such a dot inclined toward red purple that coloring of the cyan ink ejected first is dominant. Similarly, at the dot position 120, the ink materials in the backward scan are ejected onto the print medium in the order of the dot from the magenta ejection nozzle 113 of the recording head 104 (M2) and the dot from the cyan ejection nozzle 111 of the recording head 105 (C2). At the dot position 120 there normally appears such a dot inclined toward red purple that coloring of the magenta ink ejected first is dominant.

As described above, the present embodiment always uses the pair of the blue dot inclined toward red purple and the blue dot inclined toward violet. From a microscopic aspect, dots with difference in coloring are alternately arranged in each column. When this is macroscopically observed at the pixel 130, the ejection (application) order in the forward scan is the cyan dot from C2, the magenta dot from M2, the magenta dot from M1, and the cyan dot from C1; whereas the ejection order in the backward scan is the cyan dot from C1, the magenta dot from M1, the magenta dot from M2, and the cyan dot from C2. Therefore, the pixel structure is obtained by the symmetric ejection orders. Therefore, coloring of intermediate blue can uniformly be effected in pixel units.

As described above, for substantiating the present invention, it is important that the dominant state be that the colors forming the secondary color of each pixel are ejected in the symmetric orders into the pixel. The present example was the example of blue (cyan and magenta) as the secondary color, but it is obvious that the same can also apply to the cases of red (magenta and yellow) and green (cyan and yellow). Further, it can also be readily understood that the same effect is accomplished with the process colors of secondary and higher colors as long as colors forming each process color are ejected in symmetric orders into the pixel.

Figure 6:
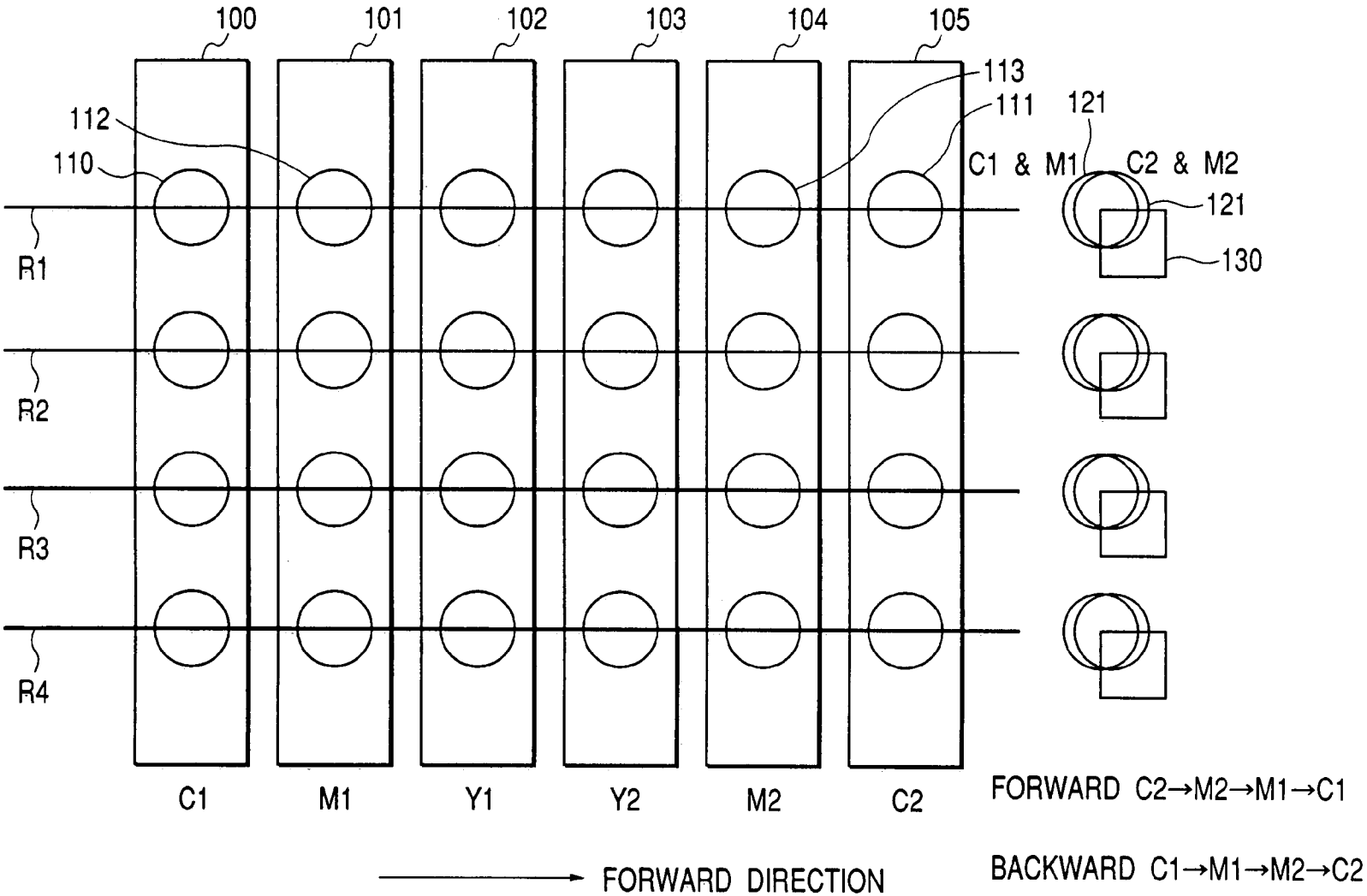
FIG. 6 is a diagram to show still another example of arrangement of recording heads and ejection nozzles and structure of pixels.

FIG. 6 shows a case in which two dots of cyan and magenta are laid at the dot position 121 on the pixel 130 by use of the head cartridge 1 of the same structure as in FIG. 3. In this case, the ink materials are laid all in the almost dot-on-dot configuration for the pixel structure.

At the dot position 121, the ink materials in the forward scan are ejected onto the print medium in the order of the dot from the cyan ejection nozzle 111 of the recording head 105 (C2), the dot from the magenta ejection nozzle 113 of the recording head 104 (M2), the dot from the magenta ejection nozzle 112 of the recording head 101 (M1), and the dot from the cyan ejection nozzle 110 of the recording head 100 (C1). The ink materials in the backward scan are ejected in the order of the cyan dot from C1, the magenta dot from M1, the magenta dot from M2, and the cyan dot from C2, thus obtaining the pixel structure by the symmetric ejection orders of the colors. For that reason, coloring of blue can be effected more uniformly in pixel units.

The important point in this case is also that the dominant state is that the component colors of the secondary color at the pixel are formed by ejection in the symmetric orders into the pixel.

Figure 7:
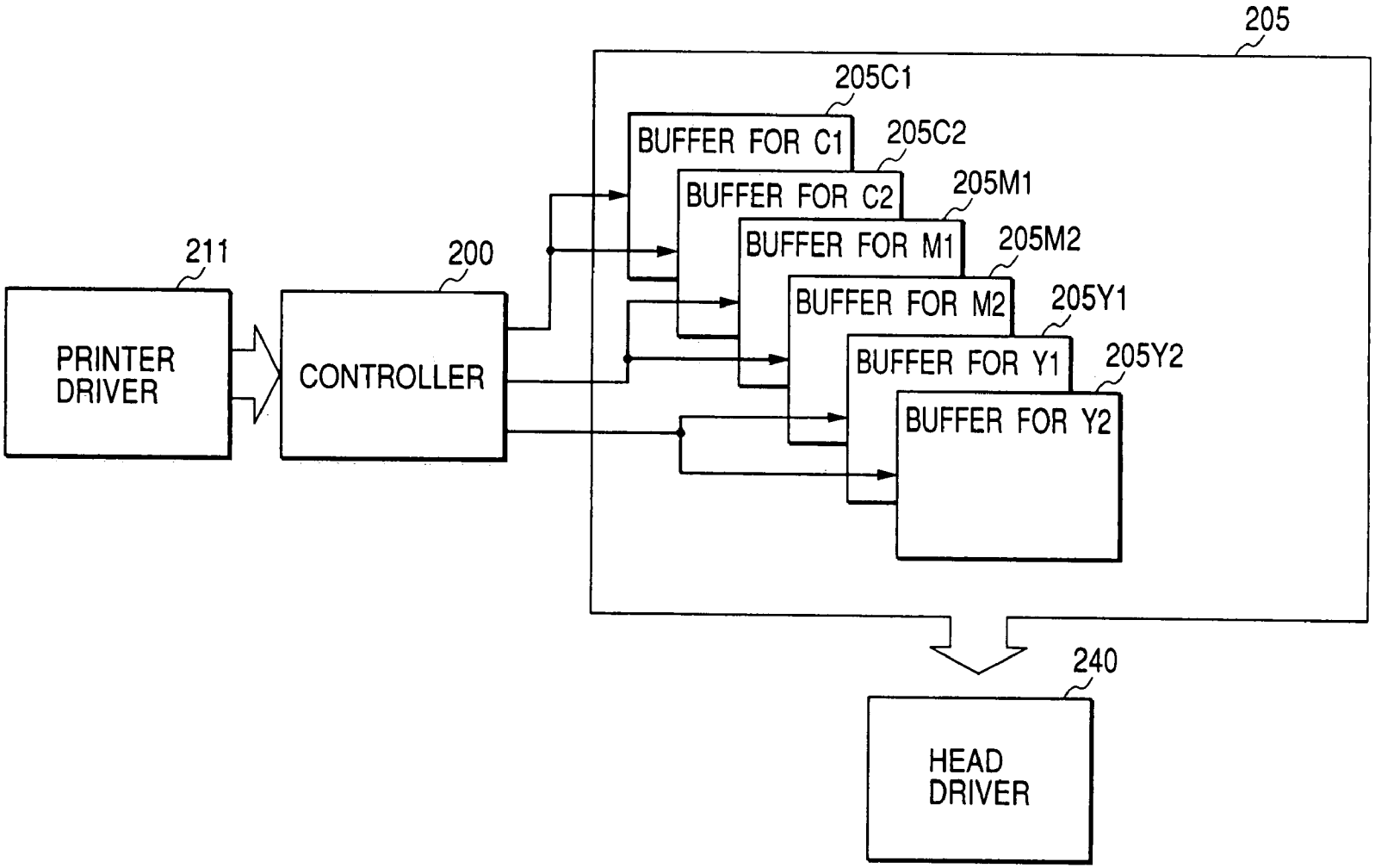
FIG. 7 is a block diagram to show a buffer configuration for print data in the present invention.

FIG. 7 is a diagram to show a data buffer configuration of the print apparatus in the present embodiment.

In FIG. 7, a printer driver 211 corresponds to the programs for preparation of image data and for transfer of prepared data to the print apparatus, in the host device 210 of FIG. 2. The controller 200 expands the image data supplied from the printer driver 211 as occasion demands, and writes 1-bit data of each color of C, M, and Y into respective print buffers 205.

For example, let us suppose that 1-bit data in 360 dpi is written for cyan on that occasion. In this case, 1-bit data is written into each of the buffers 205C1, 205C2 for the recording head 100 (C1) and for the recording head 105 (C2) in the method of the present embodiment. When each recording head arrives at the pixel position where actual recording is to be carried out, the data on each buffer is read into the register in each recording head to execute the print operation. This data and buffer structure permits the print in two-dot pairs on sub-pixels from the different recording heads. The colors employed herein were C, M, and Y, but the same can also apply, of course, to the cases of C, M, Y, and K and other colors.

The print buffers 205C1, C2, M1, M2, Y1, and Y2 are provided in the RAM 205.

Embodiment 2

Figure 8:
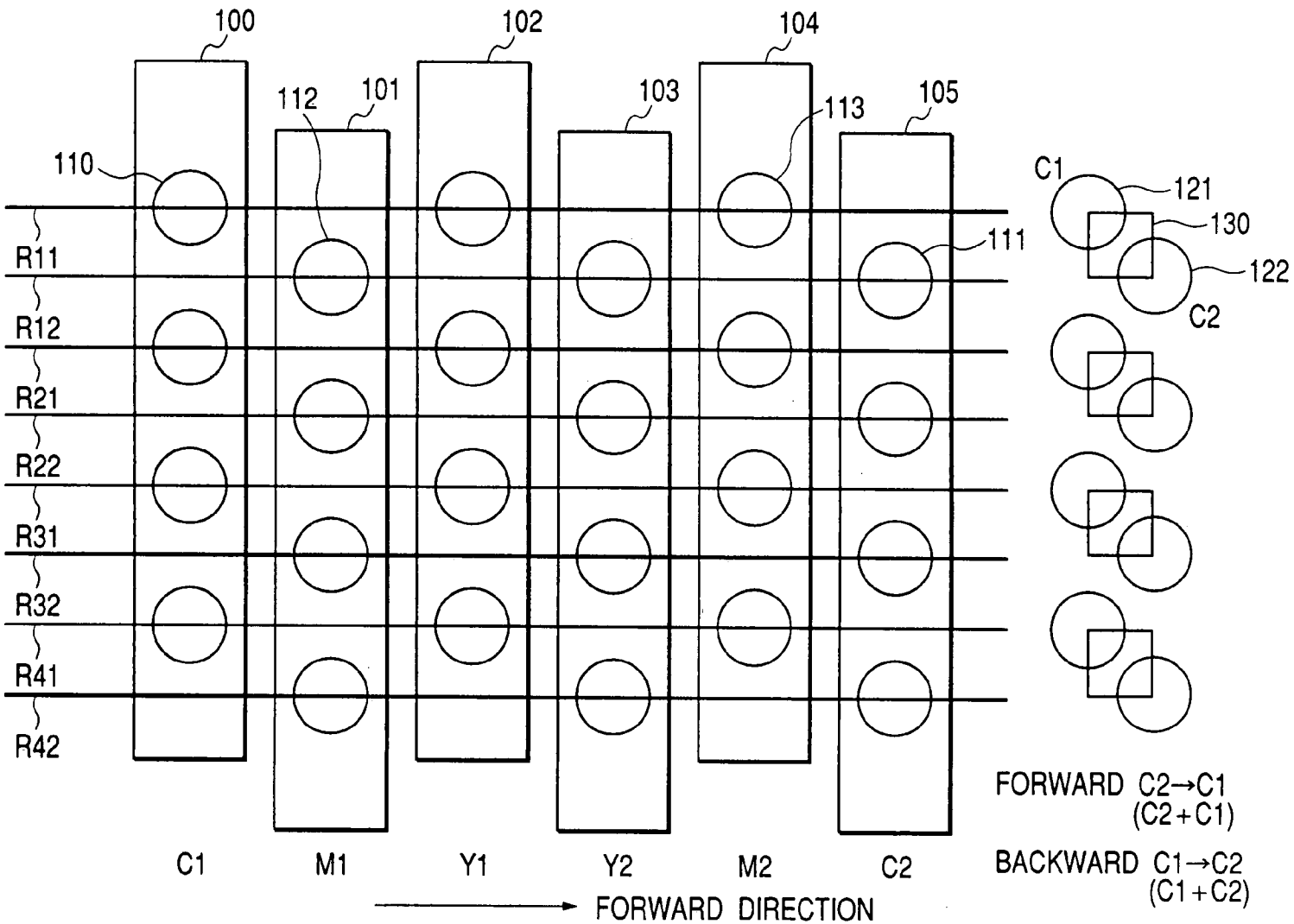
FIG. 8 is a diagram to show an example of arrangement of recording heads and ejection nozzles and structure of pixels in Embodiment 2.

FIG. 8 is a schematic diagram to partially show the structure of the principal part used as another embodiment of the recording head section in the head cartridge 1. In FIG. 8, the components are similar to those of the recording head section of FIG. 3. However, the structure of the recording head section used in the present embodiment is different from that in FIG. 3 in that in each pair of recording heads of an identical color the recording heads as a pair constituting a pixel of each color are shifted from each other by half of the pitch of the nozzles in the recording heads in the sub-scanning direction.

In the above structure, FIG. 8 shows a case in which the primary color of cyan is printed. FIG. 8 shows a state in which two dots at the dot position 121 and at the dot position 122 are printed as a pair for the pixel 130. In the same figure the dot position 121 and the dot position 122 indicate positions of the dot ejected from the ejection nozzle 110 of the recording head 100 (C1) and the dot ejected from the ejection nozzle 111 of the recording head 105 (C2), respectively, for the area of the pixel (picture element) 130. In this example, the dot position 121 indicates the position of the left upper corner in the figure and the dot position 122 the position of the right lower corder. Further, R11 and R12 represent main scanning lines or rasters to form the pixel 130. In this example, one pixel is constructed of two rasters.

Figure 9:
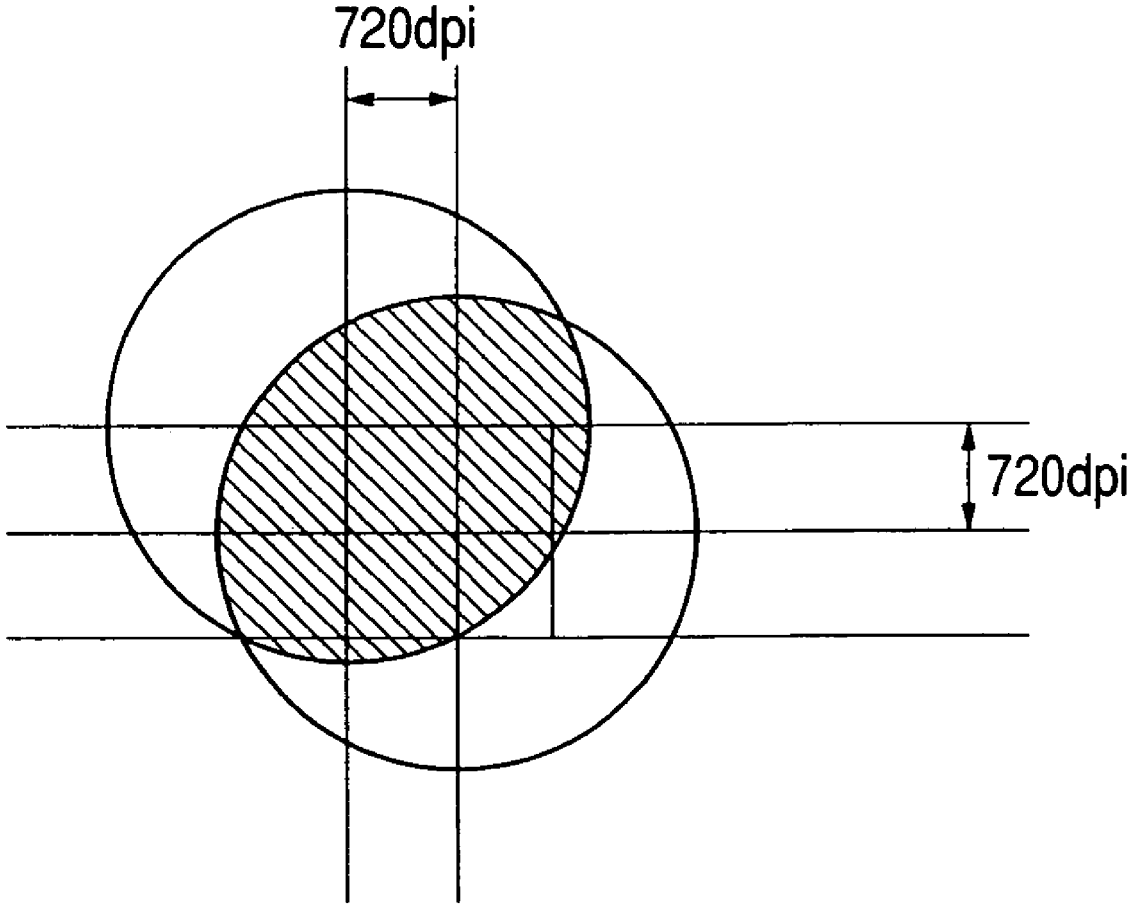
FIG. 9 is a diagram to show an overlapping state of dots in a pixel layout.

In this case, let the forward scan be movement of the head cartridge 1 in the direction indicated by an arrow in FIG. 8. Then the order of dots ejected into the pixel 130 is the recording head 105 (C2)→the recording head 100 (C1) in the forward scan and C1→C2 in the backward scan. However, there appears no difference of coloring due to the ejection orders in the case of the primary color, because the ink of the same color is ejected in the both scans. Although FIG. 8 is illustrated without any overlap between the dots at the dot position 121 and at the dot position 122, the dots normally overlap with each other in part, as illustrated in FIG. 9, in practice.

Figure 10:
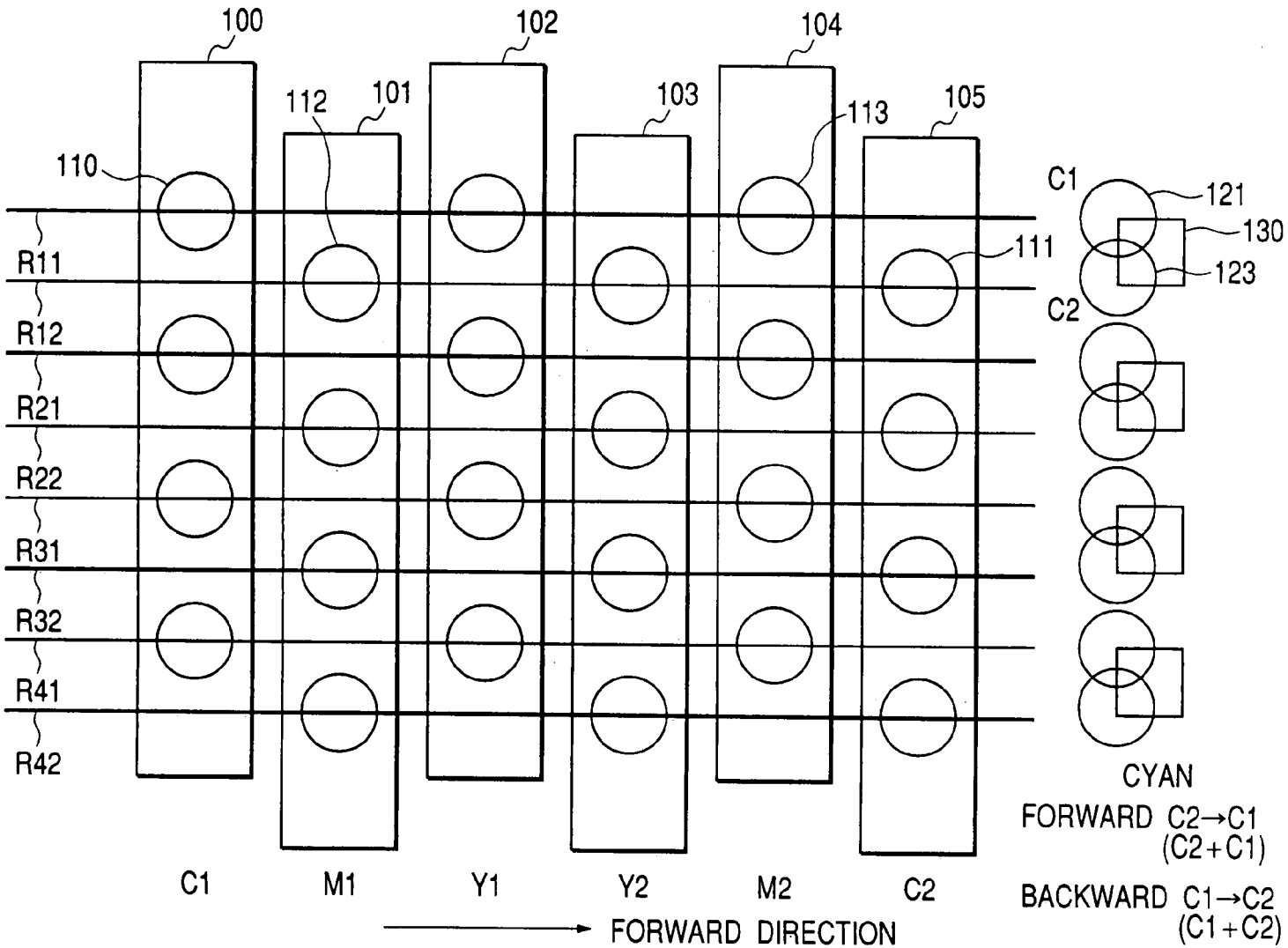
FIG. 10 is a diagram to show another example of arrangement of recording heads and ejection nozzles and structure of pixels.

FIG. 10 shows a case in which dots are laid at the dot positions 121, 123 on the pixel 130 with the head cartridge 1 of the same structure as in FIG. 8. In this case there appears no difference of coloring between in the forward scan and in the backward scan, either, because the dots of the same color being the primary color are laid.

Figure 11:
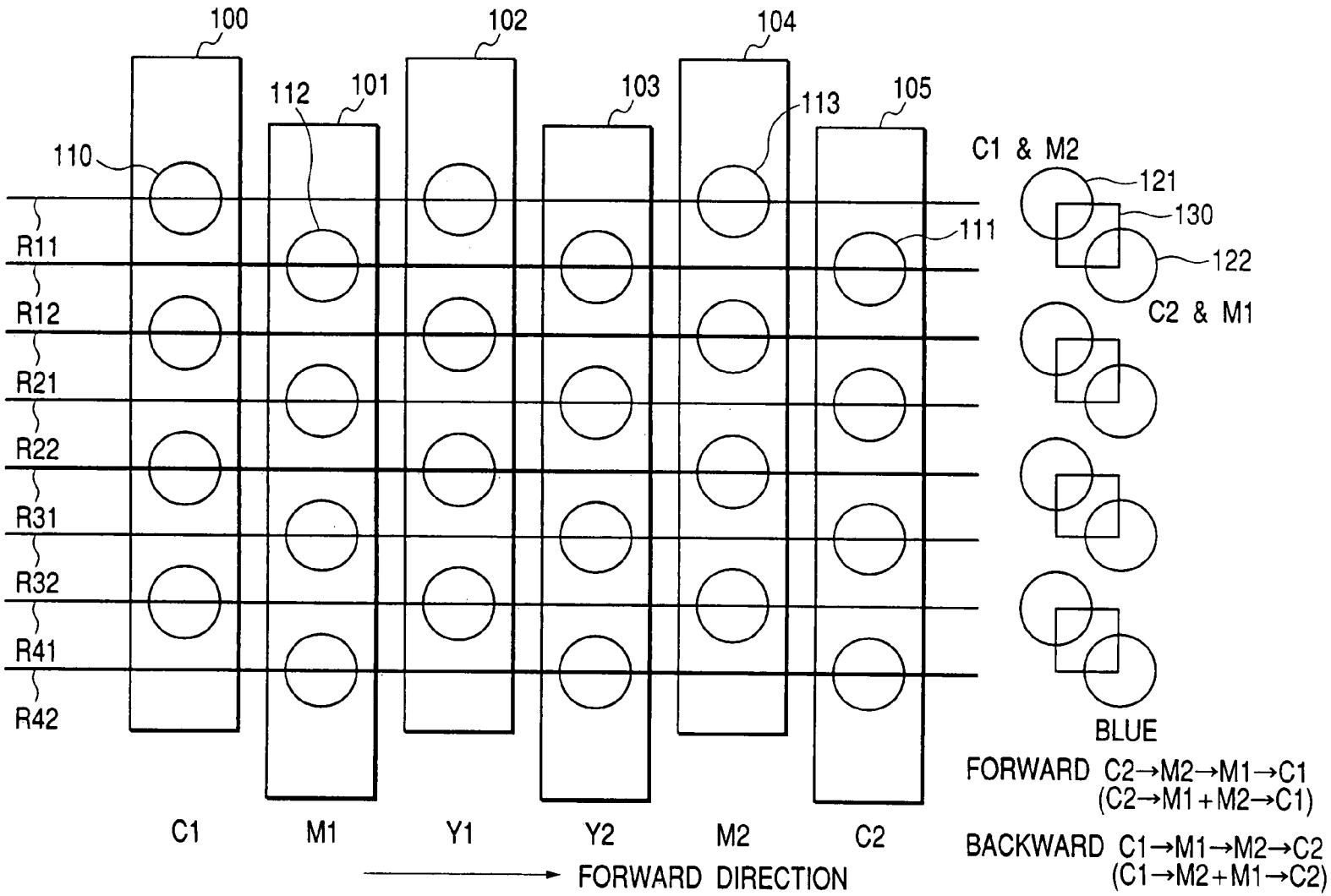
FIG. 11 is a diagram to show still another example of arrangement of recording heads and ejection nozzles and structure of pixels.

FIG. 11 shows a case in which dots of cyan and magenta are laid at each of the dot positions 121, 122 on the pixel 130 with the head cartridge 1 of the same structure as in FIG. 8. In this case, different from the layout of the pixel 130 in FIG. 8, the ink materials of the respective colors are laid in the dot-on-dot configuration for each pixel. This layout permits the colors to always demonstrate uniform coloring characteristics at the pixel 130, as in FIG. 6 of Embodiment 1.

As described above, for substantiating the present invention, it is important that the dominant state be that the dots are formed by ejecting the ink materials of the respective colors forming the secondary color for the pixel in the symmetric orders into the pixel. The present example was the example of blue (cyan and magenta) as the secondary color, but it can be readily understood that the same can also apply to the cases of red (magenta and yellow) and green (cyan and yellow).

Figure 12:
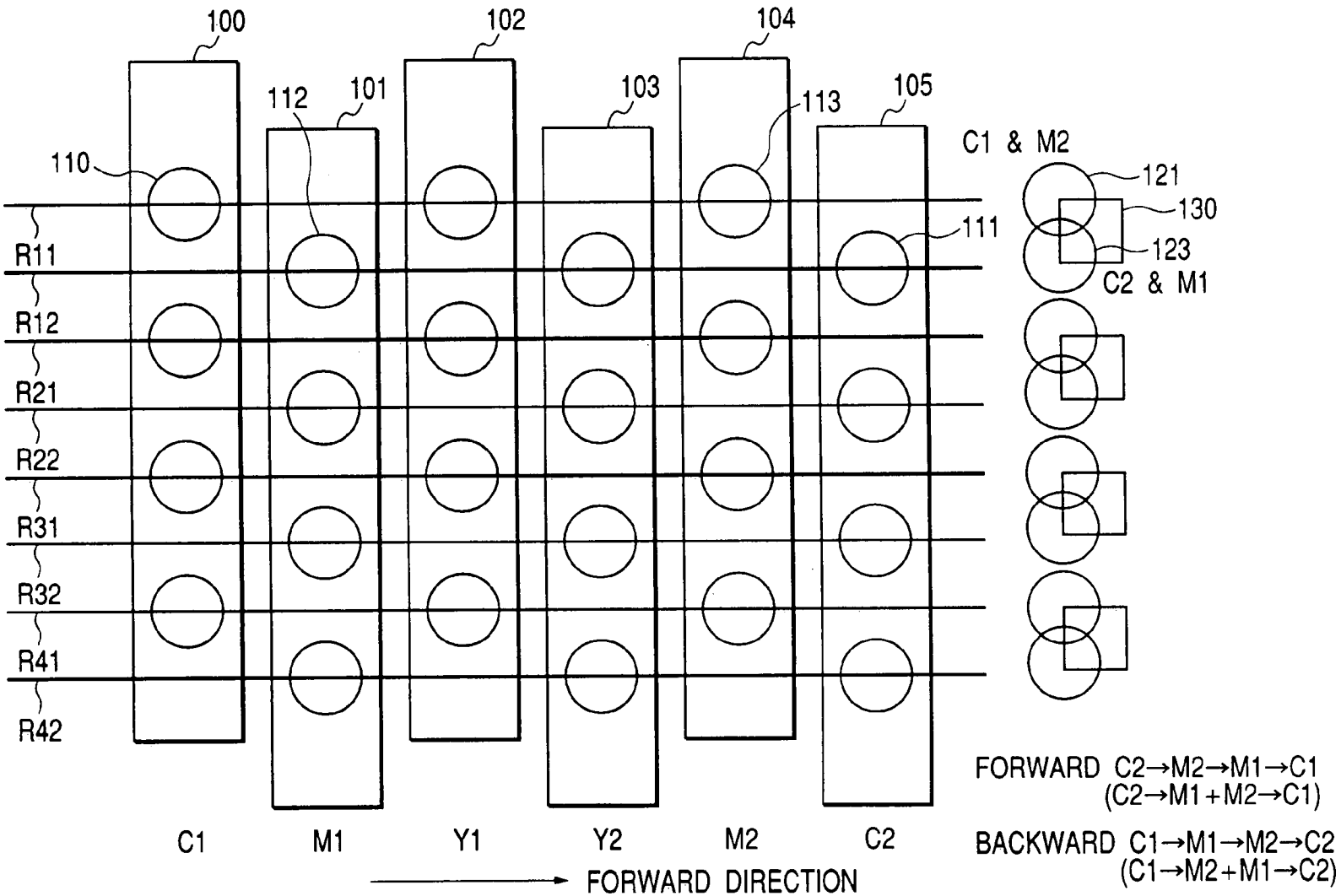
FIG. 12 is a diagram to show still another example of arrangement of recording heads and ejection nozzles and structure of pixels.

FIG. 12 shows a layout in which the ink materials of the respective colors are laid in the dot-on-dot configuration at the dot position 121 and at the dot position 123 on the pixel 130 with the head cartridge 1 of the same structure as in FIG. 8. In this state, uniform coloring characteristics can also be always demonstrated at the pixel 130, as in FIG. 11.

Figure 13:
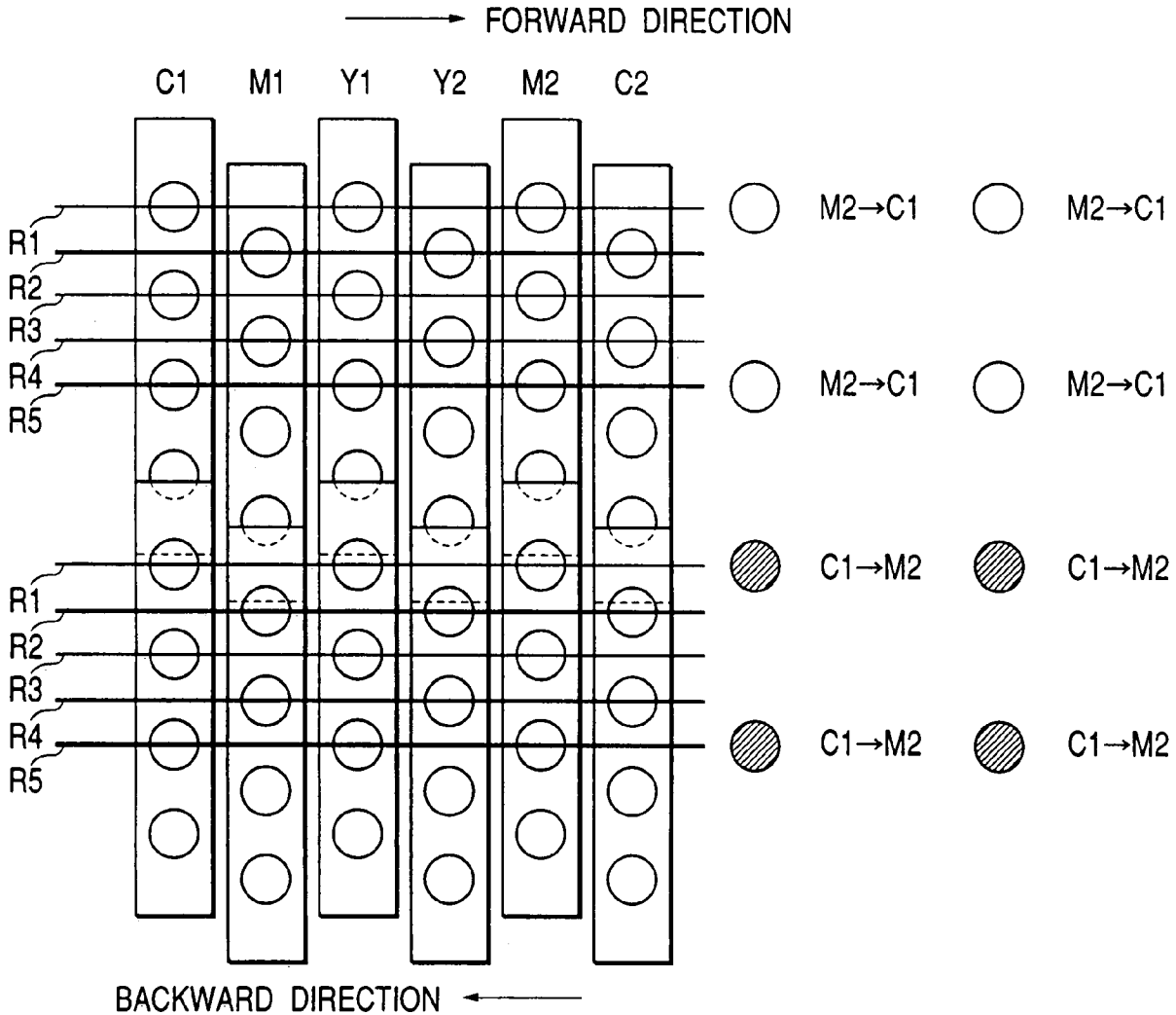
FIG. 13 is a diagram to show the principle of occurrence of uneven color due to interference of data in the two-way print in the conventional example.

FIG. 13 shows a state in which the two-way print was implemented by the method of the prior art. FIG. 13 shows tones of dots laid in certain columns in the case where half tones, horizontal rules, or hatching lines were printed in such a layout that dot data of blue (cyan and magenta) is in rasters R1 and R5.

In the forward scan the magenta (M) ink is first ejected and then the cyan (C) ink is ejected; whereas the order is reverse in the backward scan. It is clearly seen from this figure that there still appears the difference between tones in the forward scan and in the backward scan, depending upon the print data, with simple use of the head cartridge in which the recording heads of yellow, magenta, and cyan are arranged in symmetry.

Figure 14:
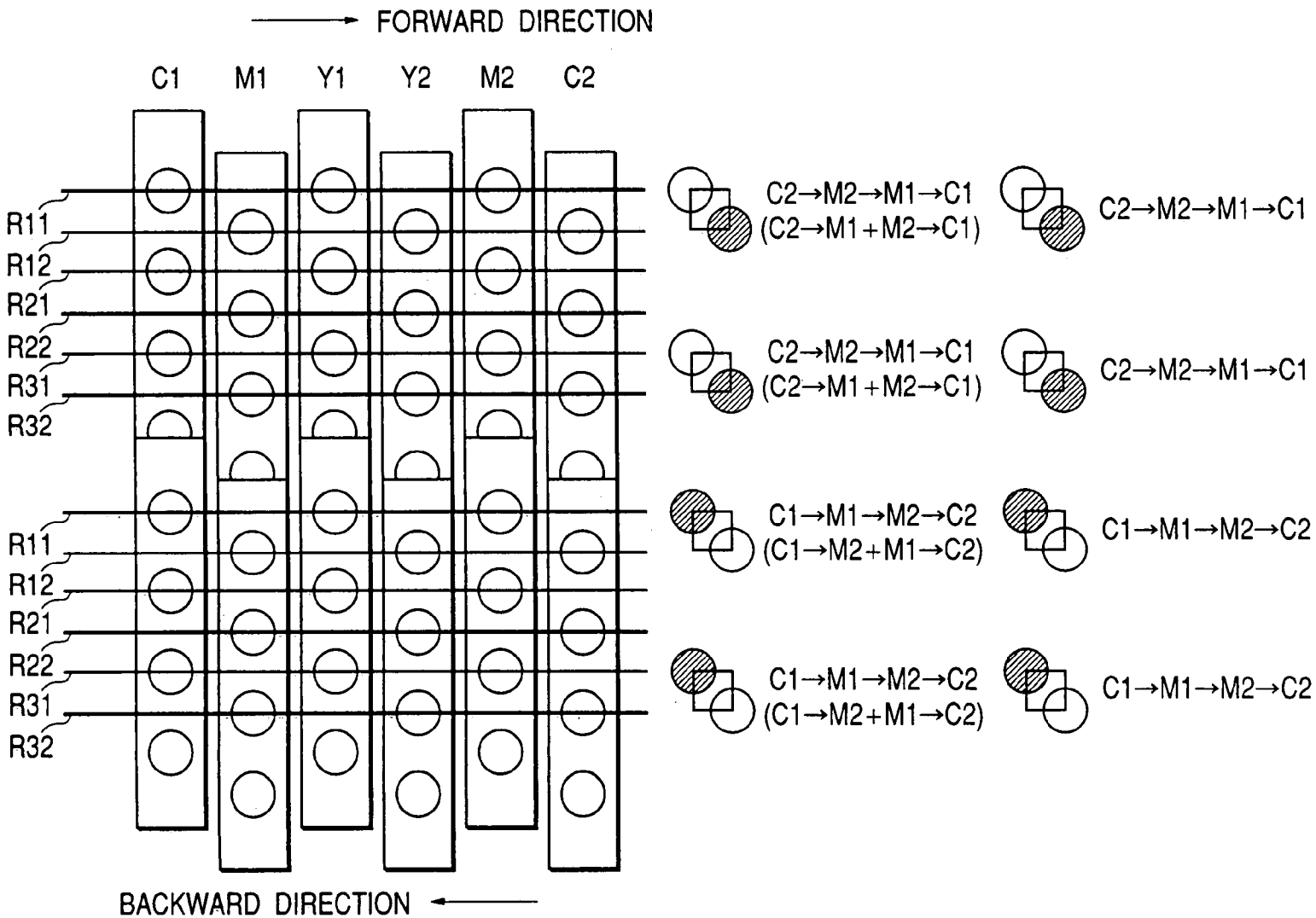
FIG. 14 is a diagram to show a principle of suppressing the uneven color due to interference of data in the two-way print in the present invention.

FIG. 14 shows a state in which the two-way print was implemented by the method in Embodiment 2 of the present invention. Even if half tones, horizontal rules, or hatching line are printed in the layout where the dot data of blue is in rasters R11, R12 and R31, R32 for formation of one pixel, the ejection order in each pixel will be always symmetric in the print along either direction by employing the layout wherein two sets of dots in the symmetric ejection order are laid at each pixel. Therefore, coloring can be always uniform independent of the print directions.

It is noted that the structure of the symmetric recording heads according to the present invention is not limited to those illustrated in FIG. 3 and FIG. 8. For example, the structure can also be selected from those of the recording heads illustrated in FIG. 15 to FIG. 19, but any other structure can be employed as long as the action and effect of the present invention is demonstrated.

Figure 15:
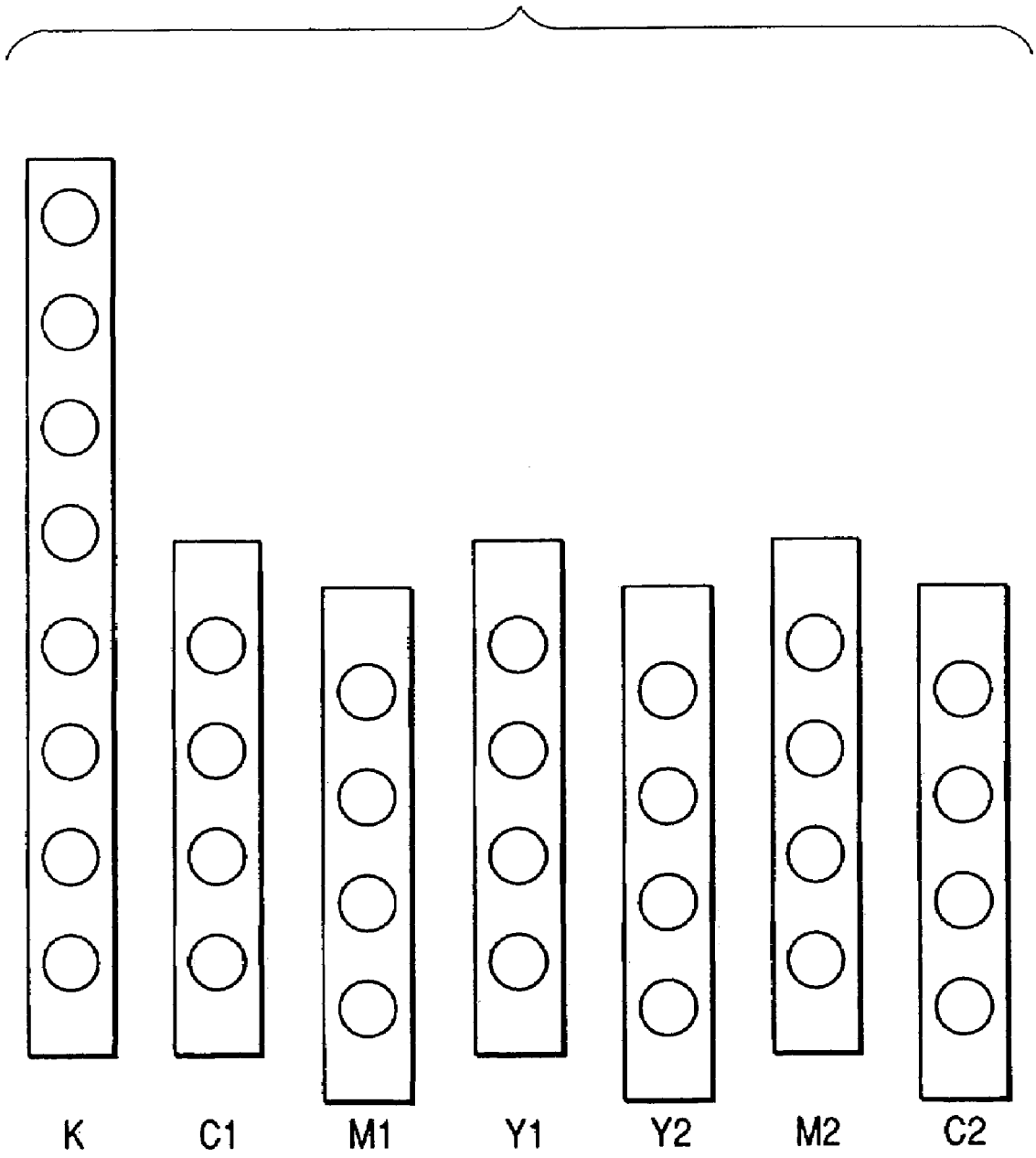
FIG. 15 is a diagram to show another example of arrangement of recording heads and ejection nozzles.

FIG. 15 shows the head cartridge provided with a black recording head for applying the ink of black (K), in addition to the configuration of FIG. 8. Since black is normally not used for formation of secondary color, the black head does not have to be placed in the symmetric layout and includes more nozzles for increase of recording speed in monochromatic recording than those in the heads of the other colors.

Figure 16:
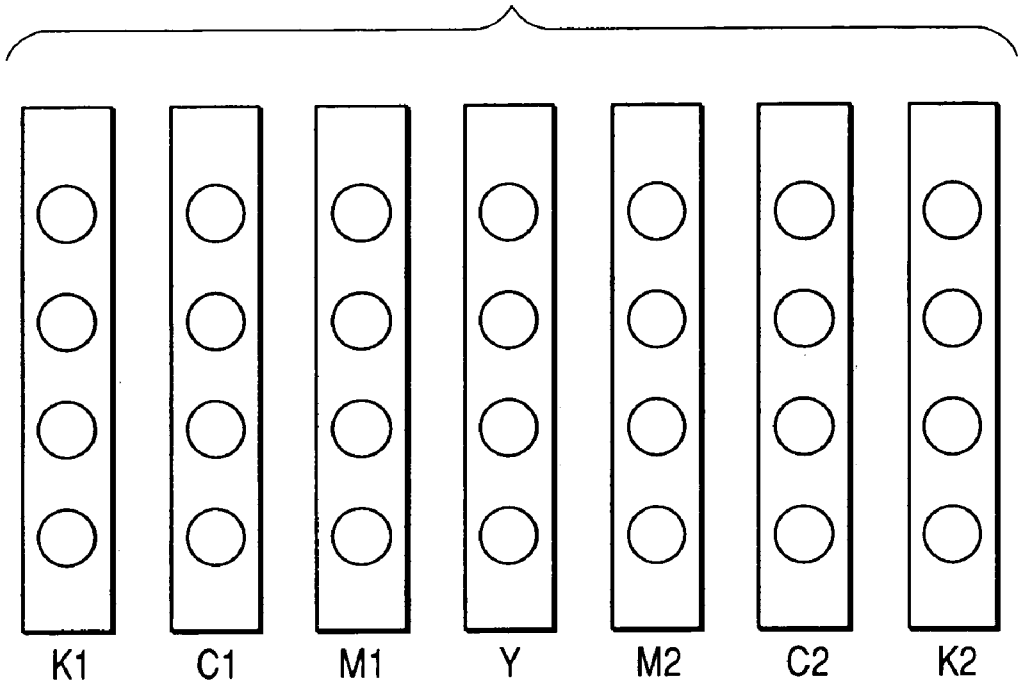
FIG. 16 is a diagram to show still another example of arrangement of recording heads and ejection nozzles.

FIG. 16 shows the head cartridge in simplified structure wherein the black recording heads for applying the ink of black (K) are added to the structure of FIG. 3 on the both sides and wherein only one head of yellow (Y) is provided in the symmetry center. The reason is that the recording head in the symmetry center is always actuated later in the print along either direction. Although the yellow head is placed in the symmetry center in this example, the center head is not limited to it.

Figure 17:
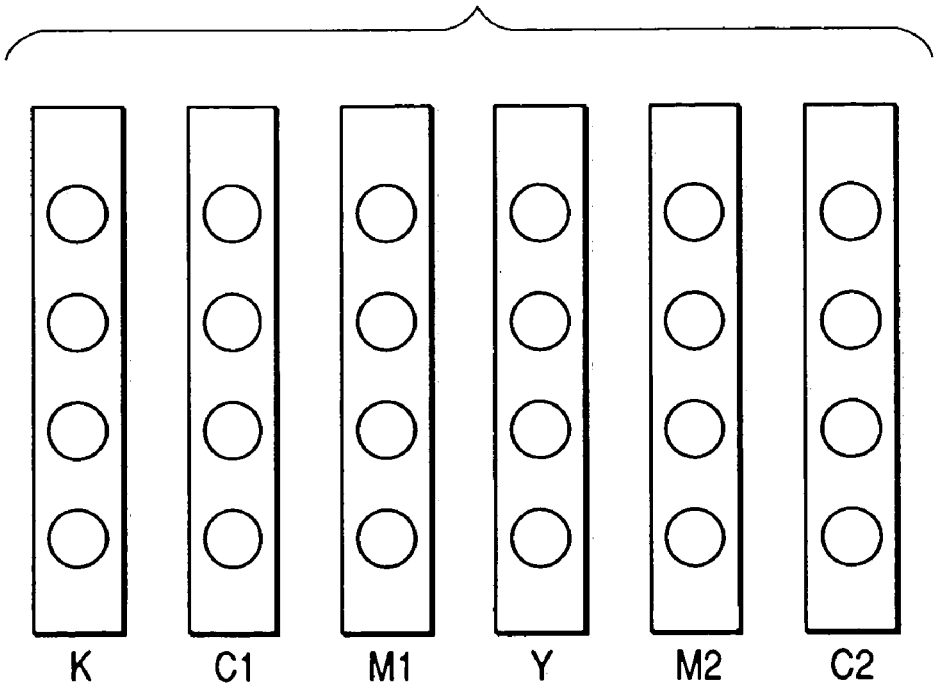
FIG. 17 is a diagram to show still another example of arrangement of recording heads and ejection nozzles.

FIG. 17 shows the head cartridge wherein only one black (K) recording head is used in the structure of FIG. 16, and the reason is the same as in the case of FIG. 15.

Figure 18:
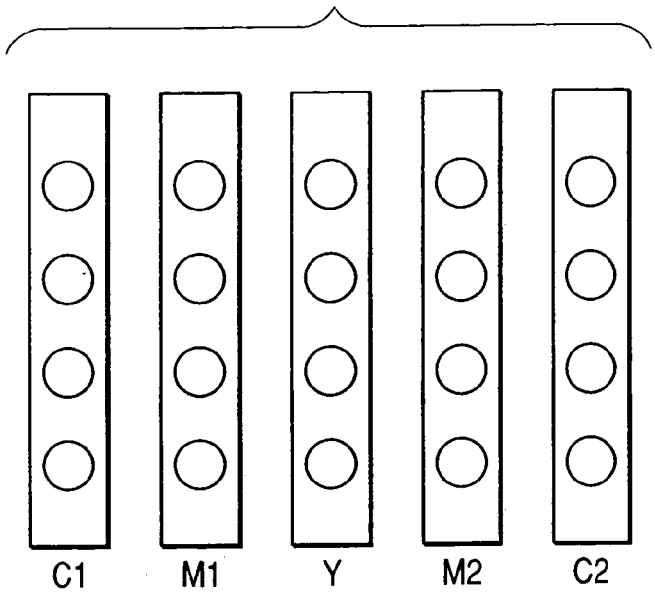
FIG. 18 is a diagram to show still another example of arrangement of recording heads and ejection nozzles.

FIG. 18 shows the head cartridge wherein only one yellow head is provided in the symmetry center in the structure of FIG. 3, so as to simplify the structure.

Figure 19:
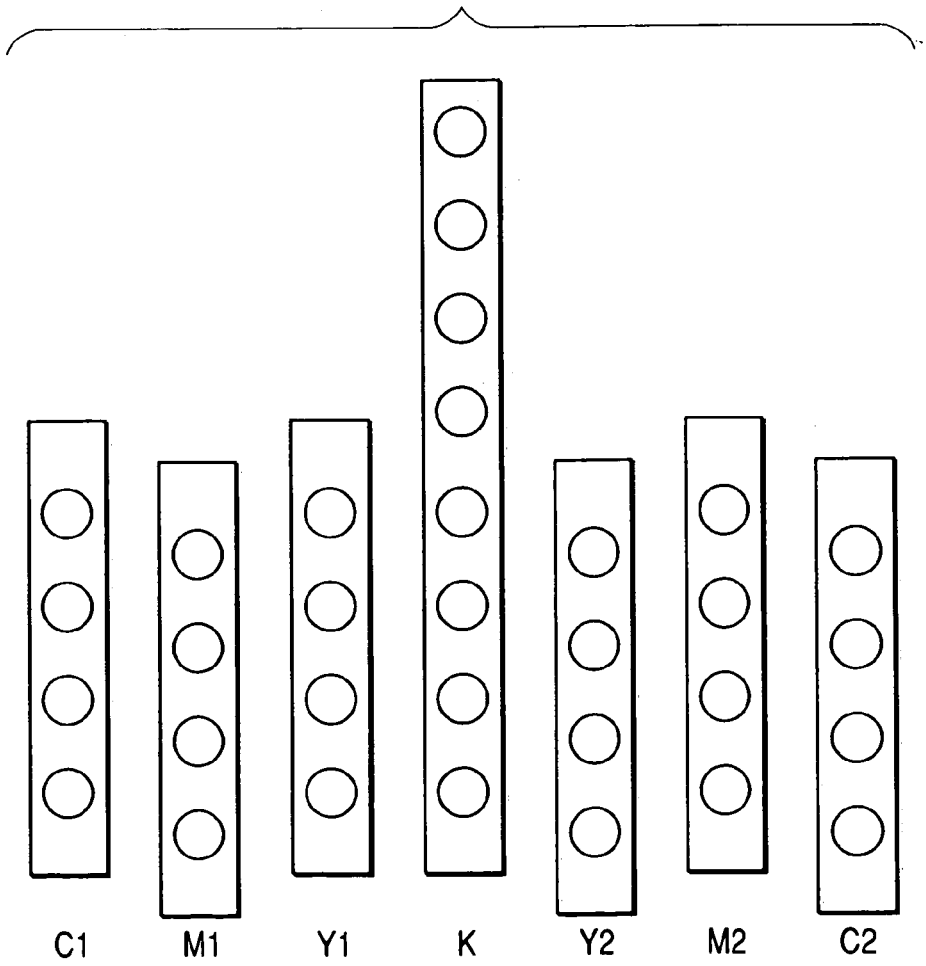
FIG. 19 is a diagram to show still another example of arrangement of recording heads and ejection nozzles.

FIG. 19 shows the head cartridge wherein the black head is placed in the symmetry center in the structure of FIG. 15.

Embodiment 3

In Embodiments 1 and 2 described above, each pixel was constructed of a pair of two dots and at least one of identical color out of the ink materials was ejected in the symmetry ejection orders. Since each pixel is formed of a pair of two dots, these embodiments are suitable for print with enhancement of image density, for example, for print in which an image is formed on an OHP sheet.

In Embodiment 3, at least one of identical color out of the ink materials is ejected in the symmetric ejection orders, as in the above embodiments, in high-density regions, and different combinations of recording heads in the forward scan and in the backward scan are used in the symmetric recording head configuration ready for the two-way print in half-tone regions. This makes it feasible to express half tones in addition to the high-density regions in the two-way print.

It has been pointed out heretofore that when the so-called, horizontal heads arranged in the main scanning direction were used as the recording heads of the respective colors in the two-way print, the ejection order in the forward scan was different from that in the backward scan in the two-way print to cause different coloring. Therefore, as described previously, proposals have been made about methods, etc. of arranging the combination of the forward recording heads and the backward recording heads along the main scanning direction and using them while completely switching between them so as to realize the same ejection order, as described in Japanese Patent Publication No. 03-77066.

The present embodiment employs the combination of control methods switched between in the high-density regions and in the low-density regions as described above. The present embodiment presents the advantage that the maximum recording frequency of the recording elements can be reduced to half of that in the conventional method of complete switching between the recording heads for forward scan and for backward scan. Conversely, the present embodiment makes it feasible to double the recordable speed.

In the case where a full solid image was printed while storing image data at full addresses on the memory, the dots were printed with the forward heads in the forward scan and with the backward heads in the backward scan in the conventional method and thus the recording elements needed to be ready for the recording frequency capable of laying dots at the full addresses. The conventional method did not allow the maximum density to be located at the full addresses and it was thus necessary to lower the maximum density or decrease the print speed.

In contrast to it, since in the method of the present embodiment dots are printed separately using the forward elements and the backward elements only in the low-density regions but using the both recording elements in the high-density regions, the maximum recording frequency can be half of that for the full addresses. Two-way unevenness can occur in the low-density regions in certain cases, but image uniformity is remarkably improved near the maximum density, as compared with the conventional example, and the speed is increased largely. Therefore, the method of the present embodiment can be a very effective means.

It is noted that the technique of expressing half tones according to the present invention is not limited to this embodiment.

Embodiment 4

By developing the concept of the present invention, uneven color in the two-way print can be reduced even without use of the recording heads of symmetric layout ready for the two-way print. Namely, the concept similar to the above embodiments can also be developed by applying multi-pass print of completing one pixel area by a plurality of scans, instead of the single-pass two-way print.

Figure 20:
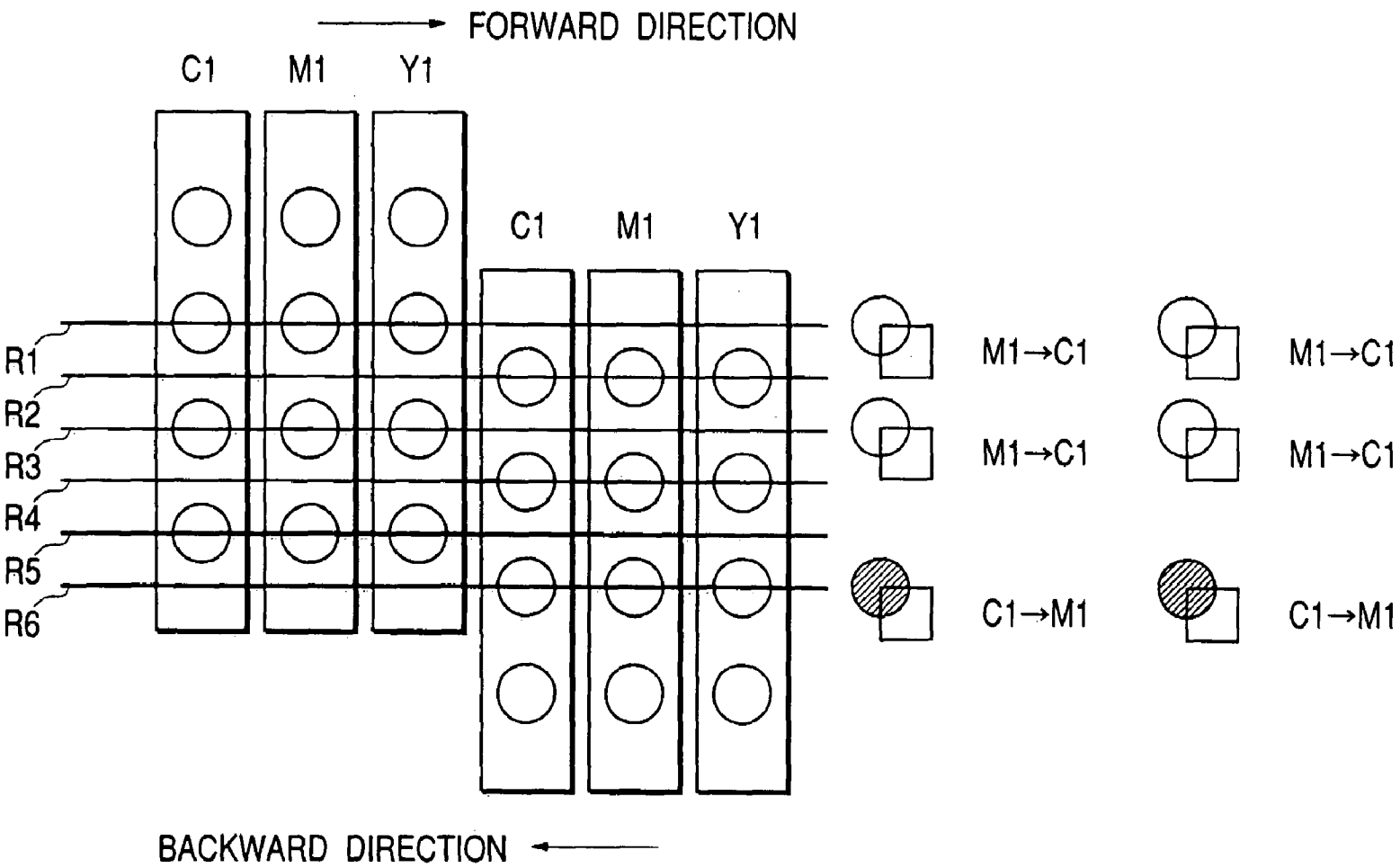
FIG. 20 is a diagram for explaining tuning of forward scanning and backward scanning with recording data heretofore.

Described below as an example is a case in which the two-way multi-pass print is implemented with the recording heads consisting of horizontally arranged recording elements of C, M, and Y. FIG. 20 shows a conventional example and FIG. 21 an embodiment of the present invention. In the both cases, after the forward scan with the recording heads, the recording heads are relatively shifted in the sub-scanning direction at pitches equal to half of the number of recording elements (2 herein)±half of the recording elements, i.e., one and half recording element pitch and two and half recording element pitch, and then the recording heads scan in the backward direction to effect the multi-pass print.

In the conventional example of FIG. 20, blue dot data is located in rasters R1, R3 in the print in the forward direction and blue dot data in raster R6 in the print in the backward direction. Therefore, interference with print data depending upon the scan directions affects in which ejection order data appears more, which will bring about uneven color. Coloring will not be uniform if distribution is not uniform in determining whether data is printed in the forward scan or in the backward scan by a dither pattern or the like.

Figure 21:
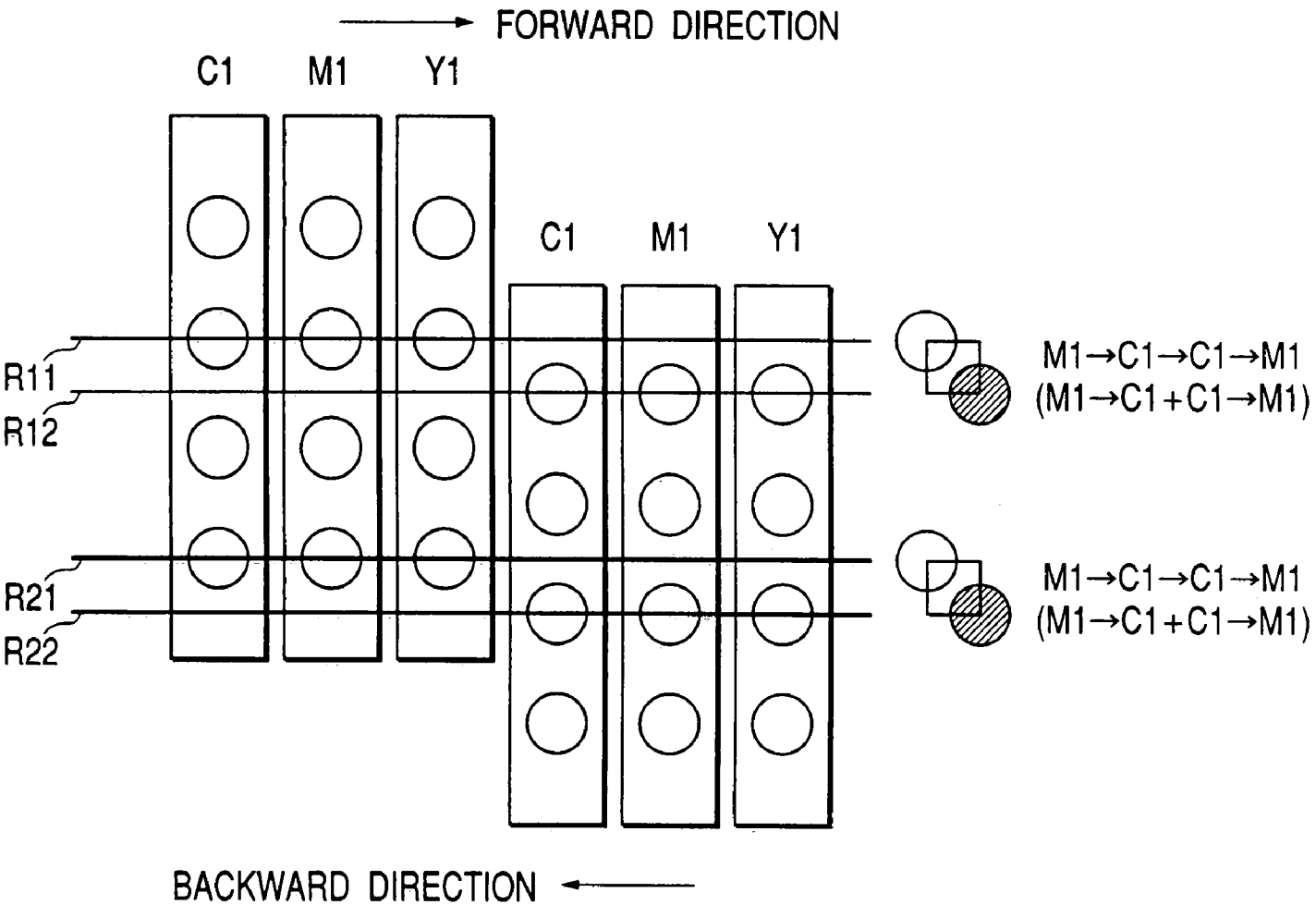
FIG. 21 is a diagram to show an example of two-way multi-pass print in Embodiment 4.

FIG. 21 shows an example of the embodiment of the present invention. In the present example, one pixel is composed of rasters R11, R12 or R21, R22. Namely, each pixel is comprised of a pair of a dot printed in the forward scan and a dot printed in the backward scan, whereby the present example permits uniform coloring in the two-way print, regardless of the print data.

FIG. 20 and FIG. 21 show the cases where the dots in the forward and backward print are laid in the interlacing relation (layout with a shift of half pitch), but the above can also apply similarly on the principle basis to the multi-pass print of a type in which dots are laid on rasters with a shift equal to the dot pitch by use of thinning masks complementary to each other.

As described above, the present invention makes it feasible to reduce the uneven color due to the application orders of ink, which used to occur on the occasion of execution of the two-way print, independent of data.

The present invention is particularly suitable for use in an ink jet recording head and recording apparatus wherein thermal energy generated by an electrothermal transducer, a laser beam or the like is used to cause a change of state of the ink to eject or discharge the ink. This is because the high density of the picture elements and the high resolution of the recording are possible.

The typical structure and the operational principle of such devices are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Patent Application Laid-Open No. 59-123670 wherein a common slit is used as the ejection outlet for plural electrothermal transducers, and to the structure disclosed in Japanese Patent Application Laid-Open No. 59-138461 wherein an opening for absorbing pressure waves of the thermal energy is formed corresponding to the ejecting portion. This is because the present invention is effective to perform the recording operation with certainty and at high efficiency regardless of the type of recording head.

In addition, the present invention is applicable to a serial type recording head wherein the recording head is fixed on the main assembly, to a replaceable chip type recording head which is connected electrically with the main apparatus and which can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. Examples of such means include a capping means for the recording head, cleaning means therefore, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single head corresponding to a single color ink, or may be plural heads corresponding to the plurality of ink materials having different recording colors or densities. The present invention is effectively applied to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiments, the ink has been liquid. It also may be ink material which is solid below the room temperature but liquid at room temperature. Since the ink is kept within a temperature range between 30° C. and 70° C., in order to stabilize the viscosity of the ink to provide the stabilized ejection in the usual recording apparatus of this type, the ink may be such that it is liquid within the temperature range when the recording signal applied. The present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, in response to the application of the recording signal producing thermal energy, the ink is liquefied, and the liquefied ink may be ejected. Another ink material may start to be solidified at the time when it reaches the recording material.

The present invention is also applicable to such an ink material as is liquefied by the application of the thermal energy. Such an ink material may be retained as a liquid or solid material in through holes or recesses formed in a porous sheet as disclosed in Japanese Patent Application Laid-Open No. 54-56847 and Japanese Patent Application Laid-Open No. 60-71260. The sheet is faced to the electrothermal transducers. The most effective one of the techniques described above is the film boiling system.

The ink jet recording apparatus may be used as an output terminal of an information processing apparatus such as computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. A print apparatus which forms a color image by applying ink materials of plural colors onto a print medium using a recording means including a plurality of nozzle arrays arranged along a predetermined direction, the nozzle array having a plurality of nozzles to eject ink materials, said apparatus comprising:

a scanner to scan the recording means in forward scanning and backward scanning directions, wherein said scanner scans along the predetermined direction;

a print controller to control the printing so that a printing means executes the printing while said scanner scans the recording means in the forward scanning and the backward scanning directions; and a changing means to change an order of application of the plural ink materials of different colors to a pixel area, wherein said print controller applies plural ink materials for each pixel area, the pixel area serving as a unit area to form a primary or secondary color thereon, wherein said print controller applies plural ink materials of different colors for forming the secondary color, to respective positions within a pixel area, and wherein said changing means can change orders of application of the plural ink materials of different colors, to the respective positions within the pixel area.

2. The print apparatus according to claim 1, wherein the plural ink materials of different colors for forming the secondary color are applied plural times onto the pixel area.

3. The print apparatus according to claim 2, wherein a plurality of dots of the secondary color are laid in different application orders of the ink material of a certain color and the ink material of the second color in the pixel area.

4. The print apparatus according to claim 1, wherein dots of the ink materials of the plural colors applied onto the pixel area have centers of gravity all substantially matching each other.

5. The print apparatus according to claim 1, wherein dots of the ink materials of the plural colors applied onto the pixel area overlap at least in part.

6. The print apparatus according to claim 1, wherein the recording means comprises a plurality of recording elements arranged in such a manner that recording elements for applying the ink material of a certain color are symmetric in a scanning direction with respect to recording element for applying the ink material of the second color.

7. The print apparatus according to claim 6, wherein the recording means comprises recording elements for applying at least ink materials of cyan, magenta, and yellow, wherein, with respect to a recording element corresponding to the certain color, the recording elements corresponding to the other colors are located in symmetry in the scanning direction.

8. The print apparatus according to claim 7, wherein the recording means further comprises a recording element for applying black ink.

9. The print apparatus according to claim 7, comprising a memory for storing data for selectively applying the ink materials of the plural colors onto the print medium in accordance with the color image, in correspondence to each of the plurality of recording elements.

10. The print apparatus according to claim 6, wherein the recording means comprises two sets of recording elements for applying at least ink materials of cyan, magenta, and yellow arranged in symmetry in the scanning direction.

11. The print apparatus according to claim 10, wherein the recording means further comprises a recording element for applying black ink.

12. The print apparatus according to claim 6, wherein the ink materials of the plural colors applied to the pixel area are applied by one scan of the recording means.

13. The print apparatus according to claim 1, wherein the ink materials of the plural colors applied to the pixel area are applied by plural scans in forward and backward scanning directions of the recording means.

14. The print apparatus according to claim 1, further comprising a memory for storing data for selectively applying the ink materials of the plural colors onto the print medium in accordance with the color image and for storing data for enabling the ink material of a certain color to be applied plural times onto the pixel area.

15. The print apparatus according to claim 14, wherein said memory is a print buffer.

16. The print apparatus according to any one of claims 1 to 15, wherein the recording means ejects the ink materials by heat.

17. The print apparatus according to claim 1, said apparatus being applied to a copy machine having a scanner.

18. The print apparatus according to claim 1, said apparatus being applied to a facsimile machine having a transmitter and receiver of data.

19. A print apparatus which forms a color image by applying ink materials of plural colors onto a print medium using a recording means including a plurality of nozzle arrays arranged along a predetermined direction, the nozzle array having a plurality of nozzles to eject ink materials, said apparatus comprising:

a scanner to scan the recording means in forward scanning and backward scanning directions, wherein said scanner scans along the predetermined direction; and a print controller to control the printing by applying plural ink materials for each pixel area, the pixel area serving as a unit area to form a color thereon, wherein, orders of application of the plural ink materials of different colors for forming the process color, to respective positions within one pixel area, are made symmetric.

20. A print method which forms a color image by applying ink materials of plural colors onto a print medium using a recording means including a plurality of nozzle arrays arranged along a predetermined direction, the nozzle array having a plurality of nozzles to eject ink materials, said method comprising the following steps:

scanning the recording means in forward scanning and backward scanning directions, wherein the scanning is performed along the predetermined direction;

controlling the printing so that a printing means executes the printing while said scanning step is performed to scan the recording means in the forward scanning and the backward scanning directions, wherein, in said controlling step, the printing means applies plural ink materials for each pixel area, the pixel area serving as a unit area to form a primary or secondary color thereon, wherein the printing on the print medium is executed by changing an order of application of the plural ink materials of different colors to the pixel area, and wherein, when the plural ink materials of different colors for forming the secondary color are applied to respective positions within a pixel area so as to print the secondary color, the orders of application of the plural ink materials of different colors to the respective positions within the pixel area, can be changed.

21. The print method according to claim 20, wherein the recording means comprises two sets of recording elements for applying the ink material of a certain color, which are arranged in symmetry in a scanning direction with respect to a recording element for applying the ink material of a second color, and wherein a first step and a second step are carried out by one scan of the recording means.

22. A print method which forms a color image by applying ink materials of plural colors onto a print medium using a recording means including a plurality of nozzle arrays arranged along a predetermined direction, the nozzle array having a plurality of nozzles to eject ink materials, said method comprising the following steps:

scanning the recording means in forward scanning and backward scanning directions, wherein the scanning is performed along the predetermined direction; and controlling the printing by applying plural ink materials for each pixel area, the pixel area serving as a unit area to form a color thereon, wherein orders of application of the plural ink materials of different colors for forming the process color, to respective positions within one pixel area, are made symmetric.

23. The print method according to claim 22, wherein the recording means comprises two sets of recording elements for applying the ink material of a certain color and recording elements for applying the ink material of a second color arranged in symmetry in the scanning direction, and wherein said scanning step is performed using the recording means.

24. The print method according to claim 23, wherein said scanning step is performed using a plurality of scans in forward and backward scanning directions of the recording means.

25. A print apparatus which forms a color image by applying ink materials of plural colors onto a print medium using a recording means including a plurality of nozzle arrays arranged along a predetermined direction, the nozzle array having a plurality of nozzles to eject ink materials, said apparatus comprising:

a plurality of buffers for storing data corresponding to respective ink materials of plural colors, said plurality of buffers corresponding to predetermined ones of the ink materials of plural colors for forming a secondary color;

a scanner to scan the recording means in forward scanning and backward scanning directions, wherein said scanner scans along the predetermined direction;

a print controller to control the printing so that a printing means executes the printing while said scanner scans the recording means in the forward scanning and the backward scanning directions;

a changing means to change an order to application of the plural ink materials of different colors to a pixel area, wherein said print controller applies plural ink materials for each pixel area, the pixel area serving as a unit area to form a primary or secondary color thereon, wherein said print controller applies plural ink materials of different colors for forming the secondary color, to respective positions within a pixel area, wherein said changing means can change orders of application of the plural ink materials of different colors, to the respective positions within the pixel area; and when recording is conducted by the predetermined ones of the ink materials of plural colors for forming the secondary color, said changing means changes the order of application of the plural ink materials, by selecting the buffers used for the recording, for each pixel area, from said plurality of buffers.

26. A data buffer configuration of a print apparatus, said configuration comprising image data of a certain color written into a plurality of print buffers by a print controller, wherein the print controller controls a printing of an image by means of a plurality of nozzles, wherein the printing is executed by applying plural ink materials for each pixel area to form a primary or secondary color thereon, the pixel area being a unit area, wherein, as to the pixel area forming the secondary color thereon, dots of the secondary color are formed, in ink materials of plural colors, at plural positions within the pixel area to form the secondary color; and wherein orders of application of the plural ink materials to respective positions within the pixel area are changed.

27. The data buffer configuration according to claim 26, wherein the same data may be written into two print buffers.

28. A print apparatus which performs printing onto a print medium, scanning in a main scan direction an ink jet head including a plurality of nozzle arrays arranged to respectively correspond to at least two colors, with symmetric color arrangement, each nozzle array having a plurality of nozzles to eject ink materials, said apparatus comprising:

a buffer to store data corresponding to ink materials of at least two colors, said buffer having a plurality of storage areas corresponding to the ink materials of at least two colors respectively;

a controller to control one(s) corresponding to ink materials of at least two colors of data received externally so as to be stored in the respective storage areas of said buffer and to apply ink materials of at least two colors to respective positions within a pixel area, wherein orders of application of the ink materials to the respective positions within a pixel area are changed; and a record control means adapted to record using data stored in corresponding one(s) of the storage areas of said buffer, by means of the nozzle arrays arranged to respectively correspond to at least two colors.

* * * * *